US009976544B2

(12) United States Patent
Morreale

(10) Patent No.: US 9,976,544 B2
(45) Date of Patent: May 22, 2018

(54) PUMP FLUID END ASSEMBLY MOUNTING SYSTEM

(71) Applicant: FMC TECHNOLOGIES, INC., Houston, TX (US)

(72) Inventor: John D. Morreale, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days. days.

(21) Appl. No.: 15/328,921

(22) PCT Filed: Jul. 31, 2014

(86) PCT No.: PCT/US2014/049042
§ 371 (c)(1),
(2) Date: Jan. 25, 2017

(87) PCT Pub. No.: WO2016/018337
PCT Pub. Date: Feb. 4, 2016

(65) Prior Publication Data

US 2017/0211565 A1 Jul. 27, 2017

(51) Int. Cl.

| | |
|---|---|
| ***F04B 53/14*** | (2006.01) |
| ***F04B 39/14*** | (2006.01) |
| ***F04B 53/16*** | (2006.01) |
| ***F04B 53/22*** | (2006.01) |
| ***F04B 39/12*** | (2006.01) |

(52) U.S. Cl.
CPC ..... *F04B 39/14* (2013.01); *F04B 39/125* (2013.01); *F04B 53/147* (2013.01); *F04B 53/162* (2013.01); *F04B 53/22* (2013.01)

(58) Field of Classification Search
CPC ..... F04B 53/22; F04B 53/125; F04B 53/147; F04B 53/162; F04B 39/14
See application file for complete search history.

(56) References Cited

U.S. PATENT DOCUMENTS 5,934,173 A * 8/1999 Murphy ..... F04B 9/045 417/464
6,419,459 B1 * 7/2002 Sibbing ..... F04B 53/162 29/888.044

FOREIGN PATENT DOCUMENTS

| | | |
|---|---|---|
| EP | 0109670 A1 | 5/1984 |
| EP | 1813823 A2 | 8/2007 |
| RU | 2305205 C2 | 8/2007 |

(Continued)

OTHER PUBLICATIONS

International Search Report and Written Opinion dated Mar. 26, 2015 for PCT/US2014/049042 filed on Jul. 31, 2014.

(Continued)

*Primary Examiner* — F. Daniel Lopez
*Assistant Examiner* — Abiy Teka
(74) *Attorney, Agent, or Firm* — Amerson Law Firm, PLLC

(57) ABSTRACT

A system for mounting a fluid end (420) of a pump (400) to a power end (410) of the pump (400) includes an upper clamping bar (448) and a clamping assembly (460) that is adapted to removably clamp the fluid end (420) to the upper clamping bar (448). The clamping assembly (460) includes a clamp bar (462) having a first tapered clamping face (462*x*) that is adapted to contact a correspondingly tapered clamping face (448*x*) on the upper clamping bar (448) when the fluid end (420) is removably clamped to the upper clamping bar (448).

23 Claims, 18 Drawing Sheets

(56) References Cited

FOREIGN PATENT DOCUMENTS

| | | | |
|---|---|---|---|
| SU | 985412 | A1 | 12/1982 |
| WO | 2007/035173 | A1 | 3/2007 |

OTHER PUBLICATIONS

Decision of Grant and Search Report dated Dec. 18, 2017 for Russian patent application No. 2017106088 dated Mar. 26, 2015 for PCT/US2014/049042 filed on Jul. 31, 2014.

* cited by examiner

FIG. 7D
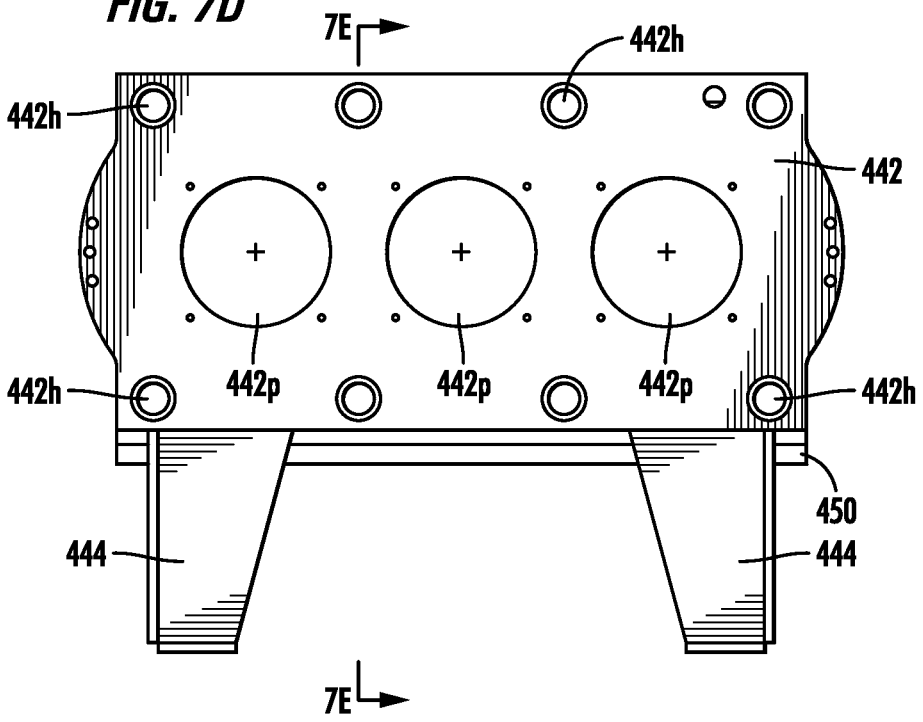
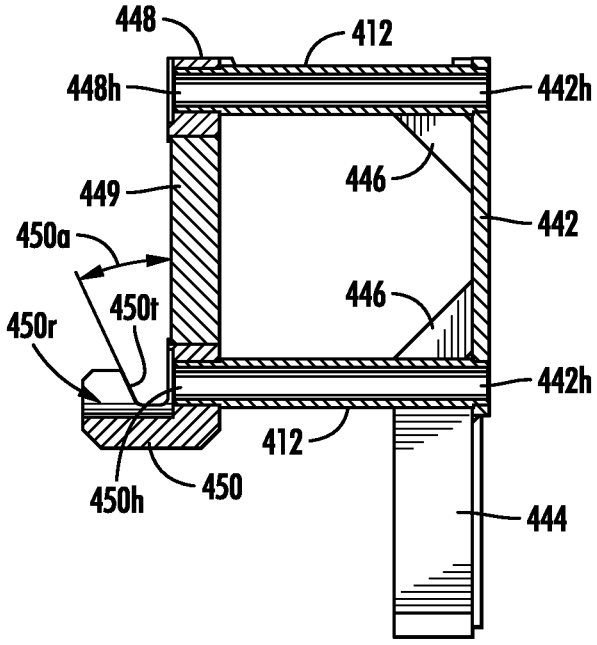
FIG. 7E

PUMP FLUID END ASSEMBLY MOUNTING SYSTEM

BACKGROUND

1. Field of the Disclosure

The present disclosure is generally directed to reciprocating pumps, and in particular, to systems, devices, and methods for mounting the fluid end assembly of a reciprocating pump to the power end of the pump.

2. Description of the Related Art

In many oilfield pumping applications, such as during water injection and/or formation fracturing operations, reciprocating pumps, such as plunger pumps and the like, are often called upon to deliver very high fluid discharge pressures. For example, the fluid discharge pressure in a typical formation fracturing operation is often in the range of approximately 70-100 MPa (10,000-15,000 psi) or even higher. Due to the operational characteristics of reciprocating pumps in general, the fluid end of the pump is subjected to high frequency cyclic pressure loading. In some extreme service pumps, such as those used for the high pressure oilfield applications noted above, very high stress intensities are frequently created along the inside surfaces of the fluid end pump housing. This is particularly the case in high stress concentration areas that occur at or near the structural discontinuities of the pump housing geometry, including the edges of the various intersecting bores passing through the housing, such as the plunger bore, suction and discharge bores, access bores, and the like.

Under the high magnitude cyclic stresses that are inherent in the high pressure pulsation loading of extreme service reciprocating plunger pumps, fatigue cracks will often develop in and around areas of high stress concentration in the fluid end pump housing, such as the various intersecting bore edges described above. Depending on the nature and extent of such fatigue cracking, it is often necessary to remove at least the fluid end of a high pressure reciprocating pump from service so that the fatigue cracks can be repaired, and/or so the pump housing can be replaced. Of course, during such repair and/or replacement activities the pump is not operating, a situation that increases both the time and overall cost of drilling operations. Therefore, in an effort to reduce pump downtime, different methods have been developed for mechanically connecting, the fluid end of a reciprocating pump to the power end. Accordingly, when repair and/or maintenance of the fluid end is required, the pump housing can be disconnected from the power end and replaced with a substantially identical pump housing unit, thus allowing pump operations to restart. FIGS. 1-3 illustrate some prior approaches that have been used for connecting the fluid end of a reciprocating plunger pump to the power end.

FIG. 1 is a partial cut-away perspective view of a prior art reciprocating pump 100 having a power end 110 for generating pumping power and a fluid end 120 for pumping fluid at a desired discharge pressure. The power end 110 is generally disposed inside of a frame or housing 111. The fluid end 120 includes a block or pump housing 121 through which a plurality of different intersecting bores pass, such as a plunger bore 137, a suction bore (not shown), a discharge bore 117, and an access bore 129. An inlet header 126 is connected to the pump housing 121 on the suction side of the fluid end 120, and an outlet nozzle 128 is connected to the housing 121 on the discharge side of the fluid end 120. The fluid end 120 also includes a plunger 124, which coupled to a plunger or pony rod 114 of the power end 110 and reciprocates inside of the plunger bore 137 during operation of the pump 100.

The fluid end 120 of the pump 100 is connected to the power end 110 by a plurality of tie rods 122, e.g., bolts, each of which passes through a spacer pipe or spacer tube 112. The spacer tubes 112 are used to provide a specified amount of standoff between fluid end 120 and the power end 110, generally based on the stroke length of the plunger 124. The tie rods 122 extend from the frame 111 of the power end 110 and pass completely through the pump housing 121—i.e., from the back side of the housing 121 to the front side—referred to here as a "through-bolted" mounting configuration. Each of the tie rods 122 are tightened by respective nuts 123, thus securing the fluid end 120 to the power end 110 with the spacer tubes 112 positioned therebetween.

In practice, when a typical through-bolted mounting configuration is employed, such as is shown for the pump 100 in FIG. 1, it can sometimes be very difficult to properly align the fluid end 120 and connect it to the power end 110. This can be further problematic as the total number of plungers 124 in the pump 100 increases, as there are more pump elements in general, and tie rods 122 in particular, to be aligned and connected. Accordingly, it can sometimes take several hours to remove a damaged or defective pump fluid end 120 from the power end 110 and re-connect a replacement fluid end 120. For example, in some applications it can take anywhere from approximately 2-6 hours to perform the required fluid end removal and replacement activities, particularly when unexpected problems arise. Additionally, in the through-bolted mounting configuration shown in FIG. 1, each of the tie rods 122 will act to resist the hydrostatic end loads that are imposed on the fluid end 120 during pump operation. As such, the tie rods 122 must generally be torqued to very high and precise pre-load levels in order to reduce the fatigue effects associated with the highly cyclic nature of the pump pressure loads, i.e., caused by the reciprocating action of plunger 124. However, even when such high pre-load levels are used, failure of the tie rods 122, such as cracking or breaking, can still occur, thus leading to additional pump down time so that failed and/or damaged tie rods 122 can be replaced.

FIG. 2 is a perspective view of another prior art reciprocating pump 200 that employs a different approach for mounting the fluid end 220 of the pump 200 to the power end 210. In some respects, the pump 200 is similarly configured to the pump 100, that is, the power end 210 is generally disposed inside of a frame or housing 211, and the fluid end 200 includes a block or pump housing 221. Additionally, an inlet header 226 is connected to the suction side of the pump housing 221 and an outlet nozzle 228 is connected to the fluid end 220 on the discharge side of the pump housing 221. The fluid end 220 also includes a plunger 224 that is coupled to a pony rod 224 on the power end 210 and which reciprocates inside of the plunger bore (not shown) during operation of the pump 200.

The fluid end 220 of the pump 200 is also connected to the power end 210 by a plurality of tie rods 222, each of which passes through a spacer tube 222 and is tightened by a nut 223. However, unlike the tie rods 122 of the pump 100 shown in FIG. 1, the tie rods 222 do not extend completely through the pump housing 221. Instead, the tie rods 222 connect the fluid end 220 of the pump 200 to the power end 210 by way of a bolted flange connection 230 that is mounted on the back side of the pump housing 221 generally referred to hereafter as a "flange bolted" mounting configuration. As shown in FIG. 2, the bolted flange connection 230 has an upper flange 225 that runs along substantially the entire length of the pump housing 221 (see, e.g., FIG. 3 described below) and a similarly configured lower flange 227 that is positioned on the opposite side of the pump plunger 224 from the upper flange 225. The tie rods 222 of the pump 200 therefore pass through holes in each of the respective upper and lower flanges 225, 227 but not through the entire pump housing 221.

FIG. 3 is a perspective view of a fluid end 320 of another prior art reciprocating pump 300, and illustrates a flange-bolted mounting configuration in greater detail. The fluid end 320 includes a pump housing 321 which has a fluid outlet 328 that is in fluid communication with each of the discharge side bores 317 of the fluid end 320. A bolted flange connection 330 is mounted on the back side of the pump housing 321 which, in the case of the fluid end 320 shown in FIG. 3, is sometimes formed as an integral part of the housing 321 by casting and/or machining.

Similar to the bolted flange connection 230 of the fluid end 220, the bolted flange connection 330 has an upper flange 325 and a lower flange 327, both of which extend along substantially the entire length of the pump housing 321. The upper flange 325 has a plurality of bolt holes **325*h* and the lower flange 327 has a plurality of boil holes 327 (one shown in FIG. 3) that correspond to each of the holes 325*h*. Furthermore, each of the bolts holes 325*h* and 327*h* receives a corresponding tie rod (not shown; see tie rods 222 in FIG. 2) that are used to connect the fluid end 320 of the pump 300 to the power end (not shown). The tie rods are then tightened using a plurality of nuts, such as the nuts 223 shown in FIG. 2**.

In general, the flange-bolted mounting configurations shown in FIGS. 2 and 3 have at least some of the same alignment, assembly, and operational problems as are described with respect to the through-bolted mounting configuration show in FIG. 1. For example, the tie rods, such as the tie rods 222 shown in FIG. 2, must generally be torqued to very precise high pre-load levels in order to reduce the fatigue effects associated with the cyclic nature of the pump pressure loads. However, since there are typically more tie rods used for the flange-bolted mounting configurations than are used for the through-bolted mounting configurations, the tie rods used for the flange-bolted mounting configurations are sometimes smaller in diameter. In such cases, the required torque levels may be more easily achievable, thus incrementally reducing the amount of time needed to assemble the fluid end to the power end.

On the other hand, the upper and lower flanges that are used for the typical flange-bolted mounting configuration are generally subjected to a high degree of cyclic bending stresses, due at least in part to the pressure pulsations of the hydrostatic end load on the fluid end as caused by the reciprocating plunger, and the manner in which the upper and lower flanges are loaded during pump operation. When coupled with the stress concentrations at the structural discontinuities around the upper and lower flanges, these highly cyclic bending stresses can lead to the creation of additional fatigue cracks, thus potentially compounding the fatigue-related problems and/or failures that are so often associated with the intersecting edges of the various internal pump bores. Therefore, while the use of the flange-bolted mounting configuration may result in an incremental time savings when replacing a damaged fluid end, the frequency at which such flange-bolted mounting fluid end configurations must be replaced can be exacerbated by the cyclic bending stresses and additional stress concentration areas associated with the flange-bolted mounting configuration.

The present disclosure is directed to various new systems, devices, and methods that may reduce and/or mitigate at least some of the above-described problems that are associated with the prior art approaches for mounting a fluid end assembly of a reciprocating pump to the power end of the pump.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

The present disclosure is generally directed to systems, devices, and methods for mounting the fluid end assembly of a reciprocating pump to the power end of the pump. In one illustrative embodiment, an system for mounting a fluid end of a pump to a power end of the pump is disclosed. The system includes, among other things, an upper clamping bar and a clamping assembly that is adapted to removably clamp the fluid end to the upper clamping bar. The clamping assembly includes a clamp bar having a first tapered clamping face that is adapted to contact a correspondingly tapered clamping face on the upper clamping bar when the fluid end is removably clamped to the upper clamping bar.

In another exemplary embodiment, a pump assembly is disclosed and includes a fluid end assembly that is adapted to pump a fluid, the fluid end assembly having an upper clamping lip and a lower clamping lip. The disclosed pump assembly further includes, among other things, and a power end assembly that is adapted to generate pumping power so as to drive the fluid end assembly, an upper clamping bar and a lower clamping rail coupled to the power end assembly, and a clamping assembly removably clamping the upper clamping lip of the fluid end assembly to the upper clamping bar and the lower clamping lip to the lower clamping rail.

Also disclosed herein is a pump fluid end assembly that is adapted to be removably clamped to a pump power end assembly. The pump fluid end assembly includes, among other things, a pump housing and an upper clamping lip extending from the pump housing, wherein the upper clamping lip has a front clamping face and a tapered clamping face that is oriented at a first acute angle relative to the front clamping face. Furthermore, the front clamping face is adapted to slidingly engage a front clamping face of an upper clamping bar that is coupled to the pump power end assembly and the tapered clamping face is adapted to slidingly engage a correspondingly tapered clamping face of a clamp bar when a clamping assembly that includes the clamp bar is used to removably clamp the pump fluid end assembly to the pump power end assembly.

An illustrative method for removably mounting a fluid end assembly of a pump assembly to a power end assembly of the pump assembly is also disclosed herein. The illustrative method includes removably attaching a spacer frame assembly to the power end assembly, and after removably attaching the spacer frame assembly to the power end assembly, positioning a plurality of clamping faces on the fluid end assembly in contact with a plurality of corresponding clamping faces on the removably attached spacer frame assembly. Furthermore, the method also includes removably clamping the fluid end assembly to the spacer frame assembly with a clamping assembly.

BRIEF DESCRIPTION OF THE DRAWINGS

The disclosure may be understood by reference to the following description taken in conjunction with the accompanying drawings, in which like reference numerals identify like elements, and in which:

FIGS. 7A-7E show various plan, elevation, and cross-sectional views of an illustrative spacer frame that may be used in some embodiments of the present disclosure to connect the fluid end assembly of a reciprocating pump to the power end.

Figure 1:
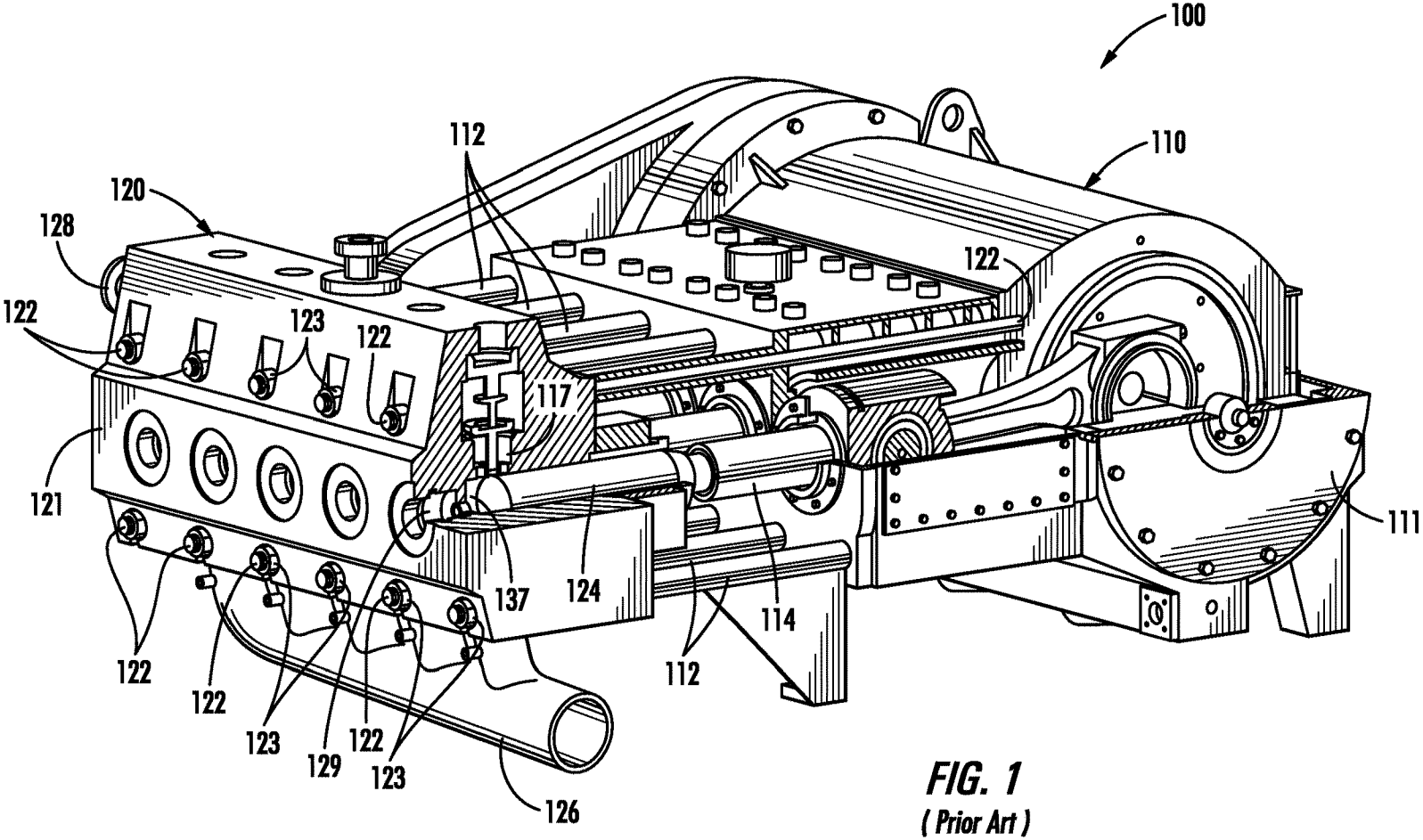
FIG. 1 ( Prior Art )
FIG. 1 is a partial cut-away perspective view of a prior art reciprocating pump showing a through-bolted method for attaching the fluid end of the reciprocating pump to the power end.
Figure 2:
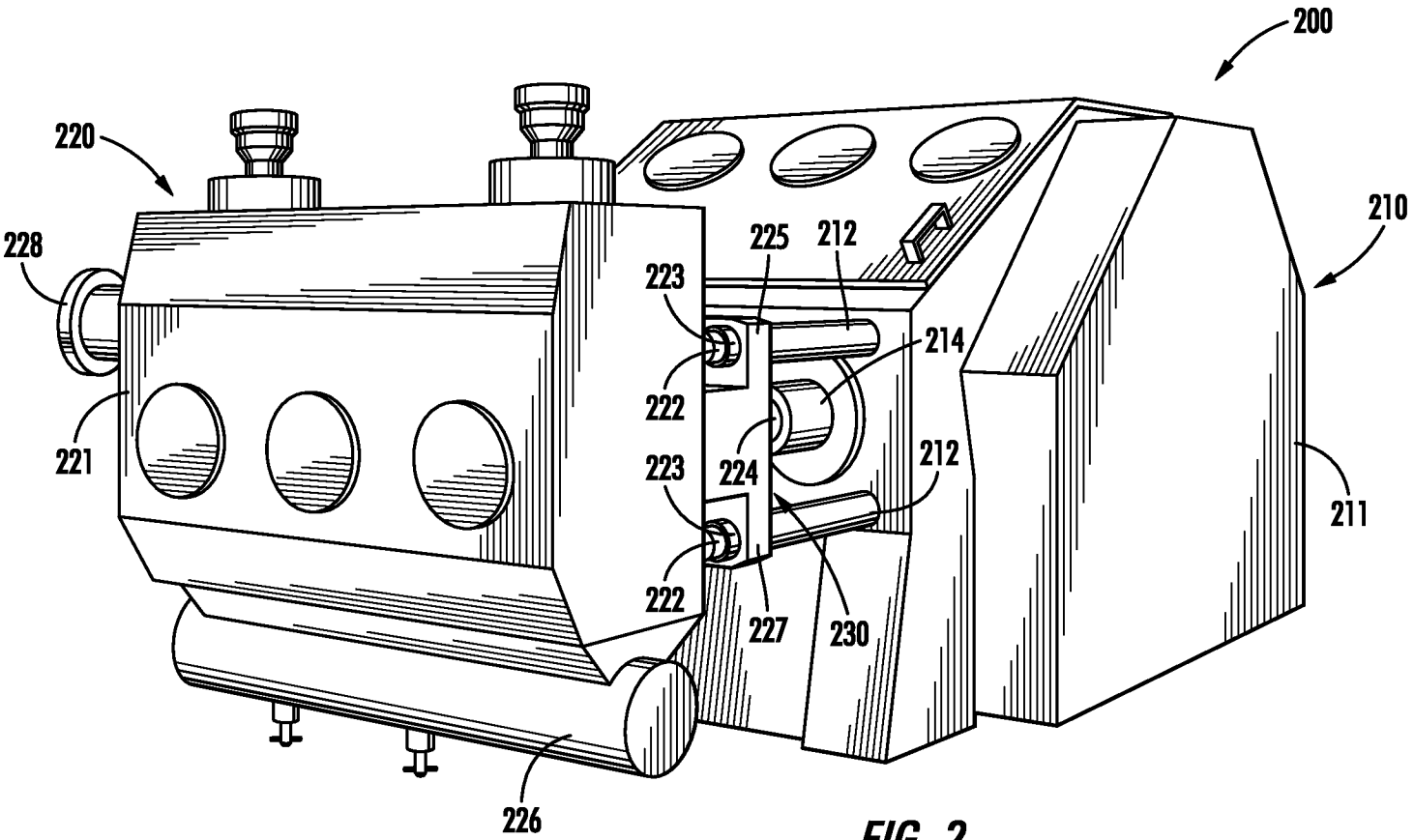
FIG. 2 ( Prior Art )
FIG. 2 is a perspective view of another prior art reciprocating pump showing a flange-bolted method for attached the fluid end of the pump to the power end of the pump.
Figure 3:
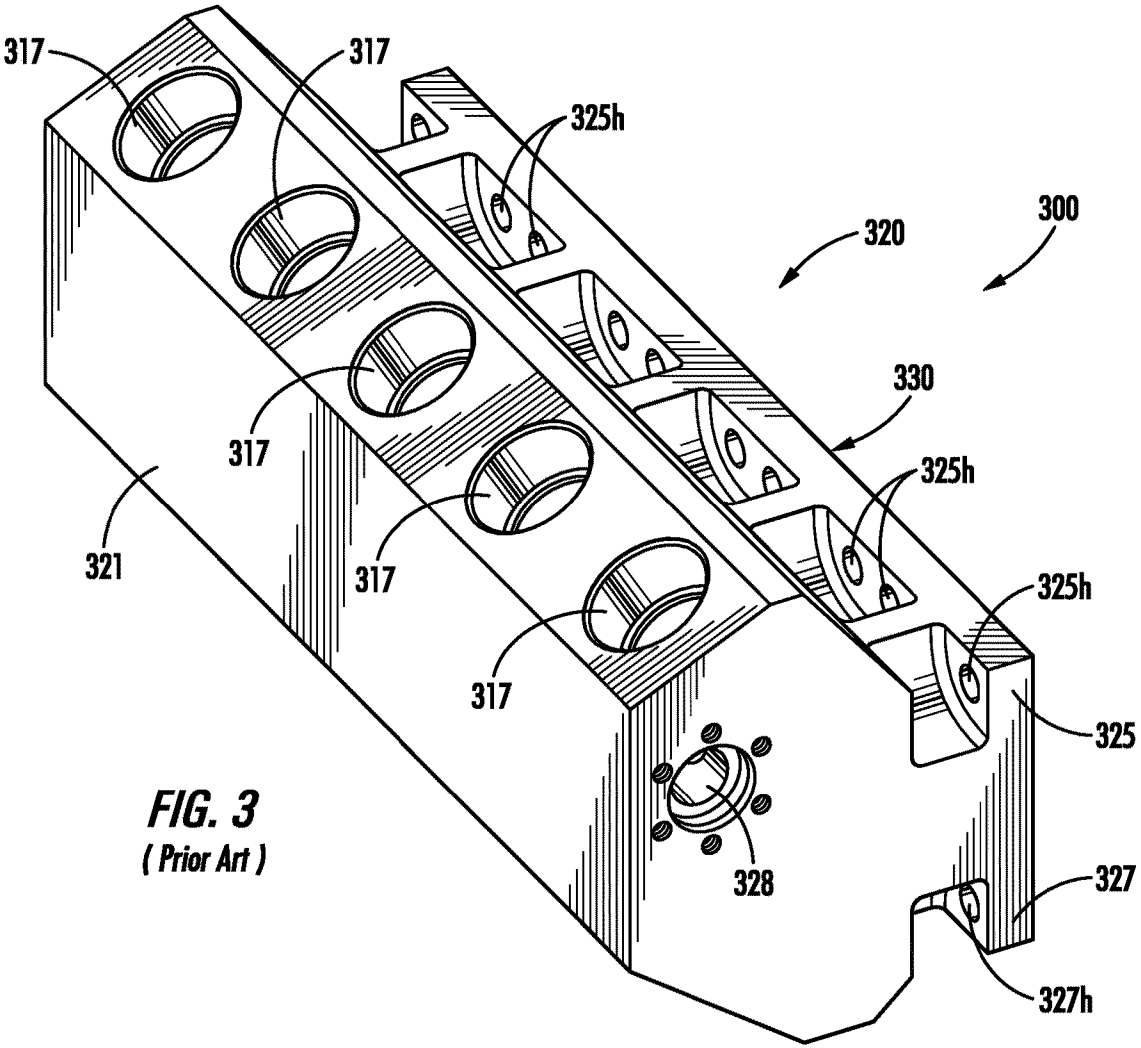
FIG. 3 ( Prior Art )
FIG. 3 is a perspective view of the fluid end of a prior art reciprocating, pump showing details of a flange-bolted mounting configuration.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In the following detailed description, various details may be set forth in order to provide a thorough understanding of the various exemplary embodiments disclosed herein. However, it will be clear to one skilled in the art that some illustrative embodiments of the inventions defined by the appended claims may be practiced without some or all of these such various disclosed details. Furthermore, features and/or processes that are well-known in the art may not be described in full detail so as not to unnecessarily obscure the disclosed subject matter. In addition, like or identical reference numerals may be used to identify common or similar elements.

Figure 4:
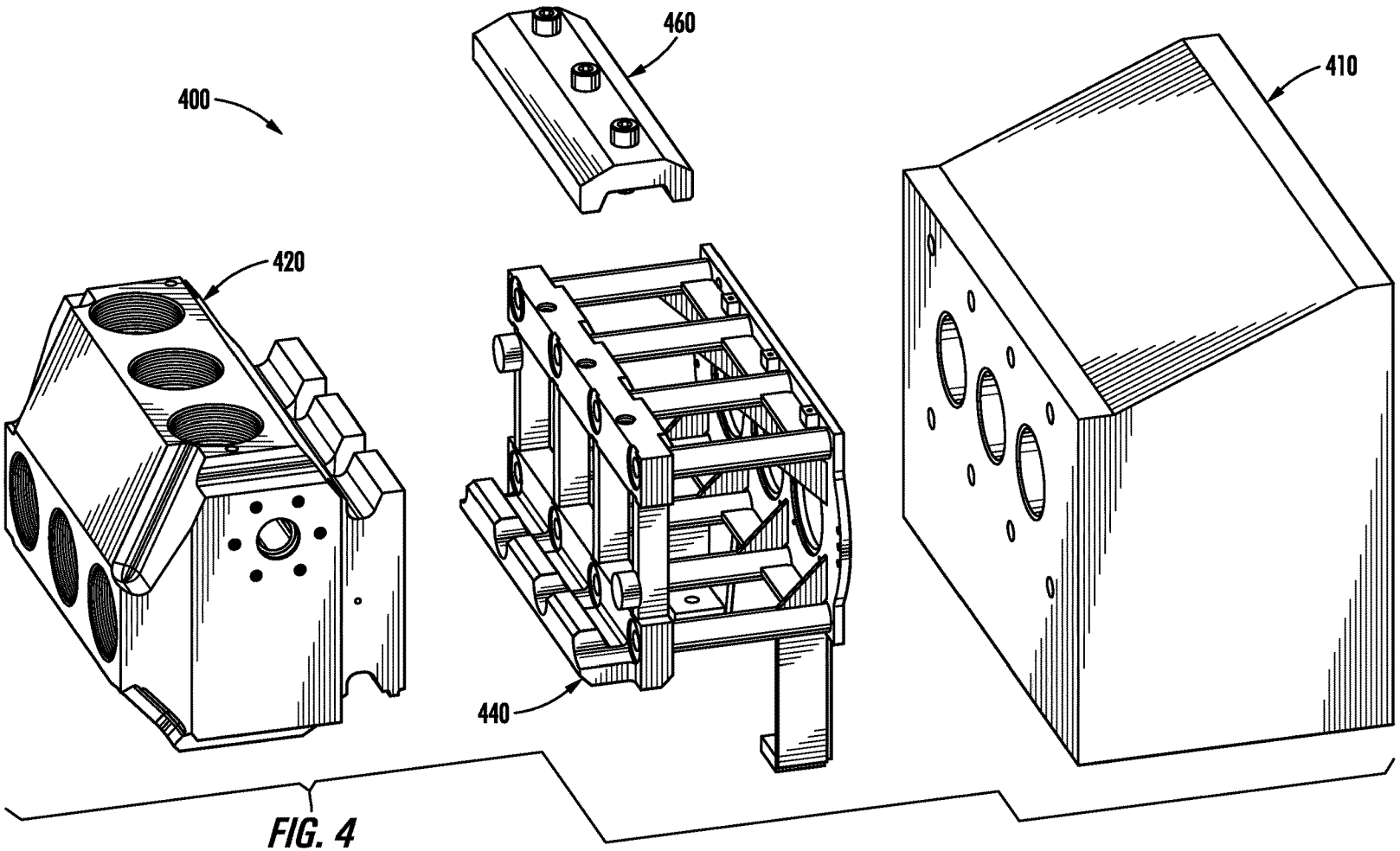
FIG. 4 is an exploded isometric view of an exemplary reciprocating pump in accordance with the present disclosure, depicting some aspects of an illustrative fluid end mounting system of the present disclosure that may be used for connecting the fluid end assembly of the pump to the power end assembly of the pump.

FIG. 4 is an exploded isometric view of an exemplary reciprocating pump 400 that utilizes one illustrative fluid end assembly mounting system in accordance with certain aspects of the present disclosure. The reciprocating pump 400 may include a fluid end assembly 420 for pumping fluid at a desired discharge pressure and a power end assembly 410 (schematically depicted only in FIGS. 4-6J) for generating pumping power so as to drive the fluid end 420. The pump 400 may also include a spacer frame assembly 440 that is adapted to be mounted on, i.e., connected to, the power end 410, and to be positioned between the power end 410 and the fluid end 420 when the pump 400 is fully assembled. Additionally, a clamping assembly 460 may be used clamp the fluid end assembly 420 to the spacer frame assembly 440, as will be further described below.

Figure 5A:
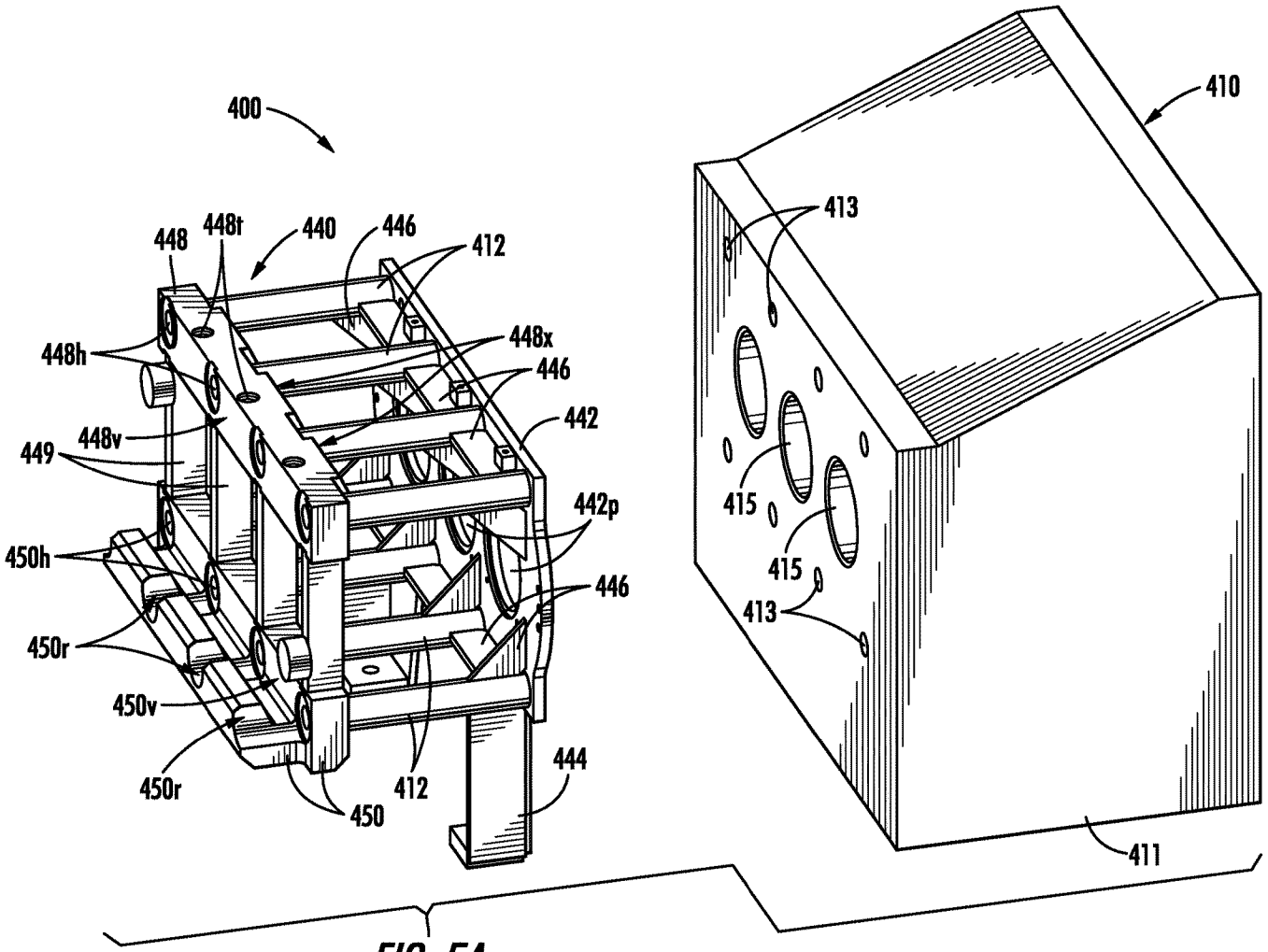
FIGS. 5A-5F are isometric views of the exemplary fluid end assembly mounting system depicted in FIG. 4, showing one illustrative sequence of steps that may be used for connecting the fluid end assembly of the pump to the power end assembly.

FIGS. 5A-5F are isometric views of the illustrative reciprocating pump 400 and fluid end assembly mounting system of FIG. 4, and depict various steps that may be used to connect the fluid end assembly 420 to the power end 410 of the pump 400. In particular, FIG. 5A illustrates an initial step in the pump assembly process, and shows the spacer frame assembly 440 positioned adjacent to the schematically depicted power end assembly 410.

In at least some embodiments, the power end assembly 410 may be disposed inside of a power end frame or housing 411 (schematically depicted in FIGS. 5A-6J). As shown in FIG. 5A, as well as in the more detailed plan, elevation, and cross-sectional views of the spacer frame 440 shown in FIGS. 7A-7E, the spacer frame 440 may include a rear plate 442 that is adapted to be in substantially direct contact with the power end 410, e.g., the power end housing 411, when the spacer frame 440 is mounted thereto. The rear plate 442 may include a plurality of openings or ports 442*p* that are adapted to be aligned with corresponding ports or openings 415 in the power end 410. The aligned ports 442*p* and 415 may thus allow the plunger/pony rods (not shown) of the power end 410 to reciprocate through the spacer frame 440 during operation of the pump 400. In at least some embodiments, the spacer frame assembly 440 may be supported by legs 444 extending downward from the rear plate 442, as shown in FIG. 5A.

In certain embodiments, the spacer frame assembly 440 may also include a upper clamping bar 448 and a lower clamping rail 450 that are adapted to facilitate the attachment of the fluid end assembly 420 (not shown in FIG. 5A) to the spacer frame 440. The upper clamping bar 448 and the lower clamping rail 450 may be laterally separated, i.e., spaced apart, from the rear plate 442 by a plurality of spacer tubes 412. In some embodiments, a plurality of gusset plates 446 may by fixedly attached, e.g., by welding, between the rear plate 442 and one or more of the spacer tubes 412 so as to provide lateral stiffness and strength to the spacer frame assembly 440. Additionally, the length of each spacer tube 412 may be appropriately adjusted so as to accommodate the stroke length of the pump 400 during operation.

As shown in FIG. 5A (see also, FIGS. 7A-7C and 7E), the upper clamping bar 448 may be vertically spaced apart from the lower clamping rail 450 by a plurality of spacer bars 449 that are fixedly attached, e.g., by welding, to each clamping component 448, 450. The upper clamping bar 448 and lower clamping rail 450 may each include a plurality of respective tie rod holes 448*h* and 450*h* that are each aligned with a respective spacer tube and a corresponding tie rod hole 442*h* through the rear plate 442 (see, FIG. 7D). Accordingly, each of the aligned tie rod holes 448*h*/450*h*/442*h* and spacer tubes 412 may therefore be adapted to receive a corresponding tie rod 422 (not shown in FIG. 5A; see, FIG. 5B), which may then be used to attach the spacer frame assembly 440 to the power end 410. For example, the tie rods 422 may be by threadably engaged with corresponding threaded elements in the power end 410, such as tie rod holes 413, schematically depicted in FIG. 5A.

Figure 5B:
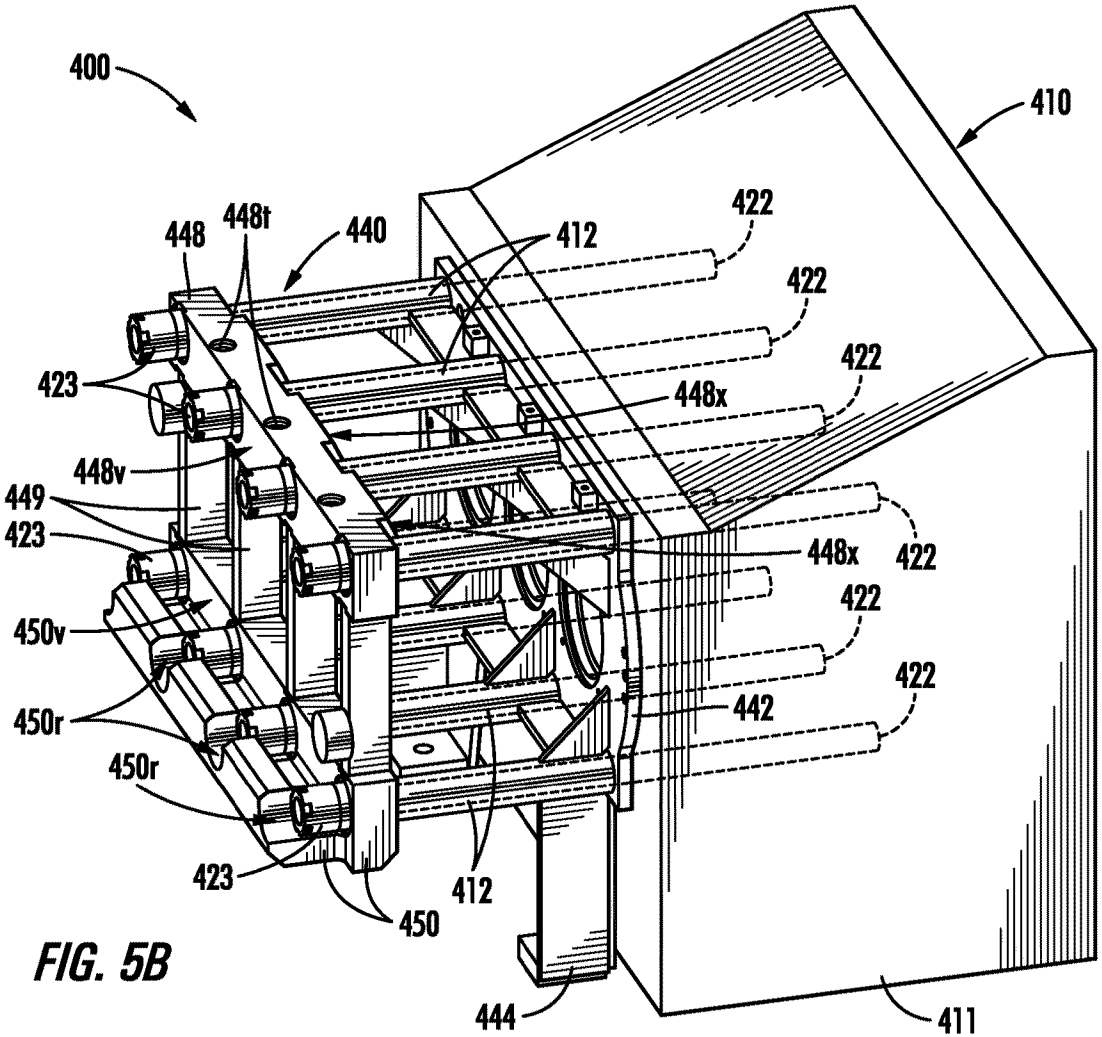

In at least some exemplary embodiments, the lower clamping rail 450 may include a plurality of relief notches 450*r* (see, FIGS. 5A, 7A, 7C and 7E), each of which may be substantially aligned with the tie rod holes 450*h* and adapted to allow the installation of a tie rod nut 423 onto a respective tie rod 422 (not shown in FIG. 5A; see FIG. 5B). In this way, the relief notches 450*r* may allow for access to the tie rod nuts 423 so that they can be properly tightened during the mounting of the spacer frame assembly 440 to the power end 410 of the pump 400, as will be described in additional detail below. Furthermore, the upper clamping bar 448 may include a plurality of tapped, i.e. threaded, holes 448*t* positioned along an upper surface thereof, which may be used to facilitate tightening of the clamping assembly 460 (not shown in FIG. 5A) when the fluid end assembly 420 (not shown in FIG. 5A) is attached to the spacer frame assembly 440 during a later assembly step, as will be further described in conjunction with FIGS. 5E-5F below.

FIG. 5B depicts the pump 400 of FIG. 5A after the spacer frame assembly 440 has been mounted on, i.e., removably attached to, the power end assembly 410. In certain illustrative aspects, a tie rod 422 (schematically depicted by dashed lines in FIG. 5B) may be installed through each of the tie rod holes 450*h* (see, FIG. 5A) in the lower clamping rail 450 and the correspondingly aligned spacer tubes 412 and holes 442*h* in the rear plate 442 (see, FIG. 7D), as well as through each of the tie rod holes 448*h* (see, FIG. 5A) in the upper clamping bar 448 and the correspondingly aligned spacer tubes 412 and holes 442*h*. After the tie rods 422 have been engaged with a corresponding element, e.g., a threaded element (not shown in FIG. 5B) in the power end 410 of the pump 400, the tie rods 422 may then be tightened to a predetermined tie rod pre-load by attaching the tie rod nuts 423 and tightening the nuts in any manner known in the art, such as by torqueing and the like. For example, in some embodiments, the tie rods 422 may have a nominal diameter of approximately 25-50 mm (1-2 inches), and the torque pre-load may be in the range of about 3400-6800 N-m (2500-5000 ft-lbs), although it should be understood that other tie rod sizes and/or torque pre-load values may also be used, depending on the specific design parameters of the pump 400, and/or the specific pumping application.

As shown in FIG. 5B, each tie rod nut 423 may be at least partially disposed within a respective relief notch 450*r* in the lower clamping rail 450, and the relief notches 450*r* may be configured and sized so as to provide access to the tie rod nuts 423 for the torqueing/pre-load step described above. Furthermore, in certain illustrative embodiments, the tie rod nuts 423 may be specially designed and sized so as to minimize the commensurate overall size of the relief notches 450*r* so as to provide the proper access for tightening. For example, in at least some embodiments, the tie rod nuts 423 may be substantially cylindrically shaped castellated nuts, as is depicted in FIG. 5B, and a specially designed tightening tool having a minimal lateral size or diameter may be used to achieved the requisite tie rod pre-load.

While FIG. 5B illustrates an exemplary embodiment wherein the spacer frame assembly 440 is removably mounted to the power end assembly 410 with a plurality of tie rods 422 and tie rod nuts 423, it should be understood by those of ordinary skill after a complete reading of the present disclosure that, in at least some embodiments, other spacer frame arrangements and/or spacer frame component configurations may also be used. For example, in certain embodiments, the mounting plate 442 may be integral to the power end assembly 410, e.g., to the power end housing 411, such that the tie rods 422 and tie rod nuts 423 are not needed to hold the spacer frame assembly 440 in place. In such embodiments, the spacer tubes 412 may have a modified configuration, such as solid bars, plates, structural shapes, and the like, since a tube-like configuration is not needed to pass a tie rod 422 therethrough. Additionally, the relief notches 450*r* may also be eliminated from at least the lower clamping rail 450, since access to a tie rod nut 423 would also not be necessary. Moreover, the support legs 444 may be differently positioned along the spacer frame 440, or even completely eliminated altogether, depending on the overall design parameters and/or required configuration of the combined integral spacer frame 440 and power end 410. In still other embodiments, the upper clamping bar 448 and the lower clamping rail 450 may be directly mounted on, or integral to, the power end assembly 410, such that at least some of the various other spacer frame components, e.g., the mounting plate 442, spacer tubes 412, legs 444, gusset plates 446, etc., may also be eliminated. In such embodiments, it should be understood that the overall size of the power end assembly 410 and/or the size of the power end housing 411 would be adjusted in an appropriate manner so as to accommodate the required stroke length of the pump 400 during operation. Therefore, while the description set forth below is directed substantially to the use of a removably attached spacer frame assembly 440, for the sake of simplicity it should be understood that the description is equally applicable to the use of spacer frame 440 that is integral to the power end assembly 410, as well as to the use an upper clamping bar 448 and/or lower clamping rail 450 that are directly mounted on, or integral to, the power end 410.

Figure 5C:
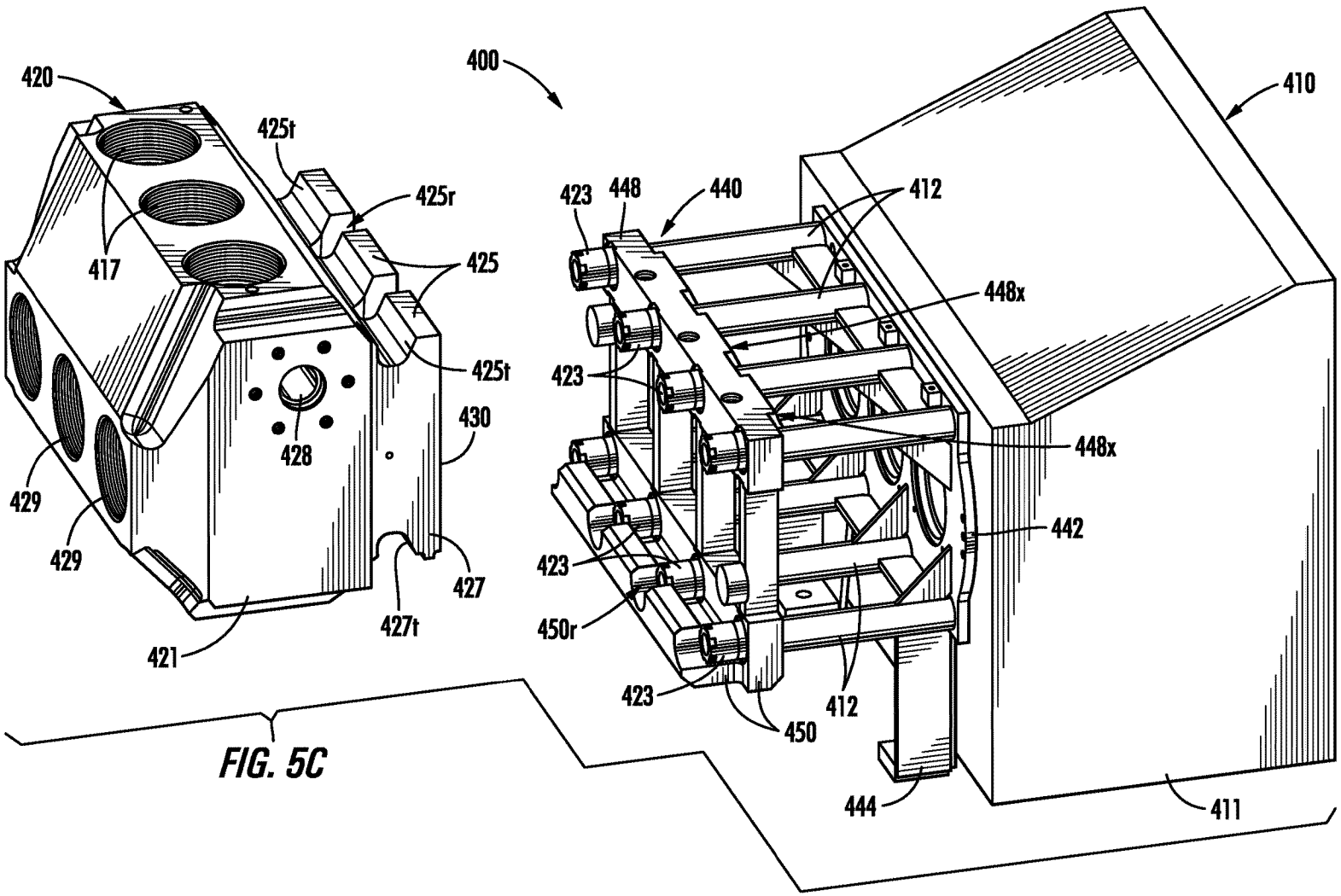

FIG. 5C shows the pump assembly 400 in a further pump assembly step, wherein the fluid end assembly 420 is positioned adjacent to, e.g., in front of, the spacer frame assembly 440 after the spacer frame 440 has been mounted to the power end 410 as described with respect to FIG. 5B above. The fluid end assembly 420 may include a block or pump housing 421 having a plurality of bore formed therethrough, such as the access bores 429 and the discharge bores 417 shown in FIG. 5C, as well as suction bores 438 and plunger bores 437 (not shown in FIG. 5C; see, FIGS. 6C, 6G and 6J). Additionally, the pump housing 421 includes a fluid outlet bore 428, which may be in fluid communication with each of the discharge bores 417. Although not shown in FIG. 5C, a fully assembled pump fluid end 420 would typically including an access cover or access bore plug 431 positioned in each access bore 429, as well as a discharge bore plug 432 (see, FIGS. 6C and 6G) positioned in each discharge bore 417 (see, FIGS. 6C and 6G).

In some embodiments disclosed herein, the fluid end assembly 420 may include a clamping boss 430 extending from the back side of the pump housing 421, i.e., from the side of the pump housing 421 that will be directly mounted to the spacer frame assembly 440 in a manner that will be further described below. The clamping boss 430 may include a plurality of upper clamping lips 425 that, in the pump orientation shown in FIG. 5C, protrude in an upward direction from the clamp boss 430, and a plurality of lower clamping lips 427 that protrude in a downward direction from the clamp boss 430, such that the upper clamping lips 425 are diametrically opposed to the lower clamping lips 427 relative to the respective plunger bores 437. As shown in FIG. 5C, each of the upper clamping lips 425 have a backside tapered clamping face 425*t*, i.e., on a face that is opposite of the spacer frame assembly 440. Similarly, each of the lower clamping lips 427 have a backside tapered clamping face 427*t*. In certain embodiments, the tapered clamping face 425*t* is adapted to slidingly engage with a correspondingly tapered clamping face 462*t* of a clamp bar 462 (not shown in FIG. 5C; see, FIGS. 5E, 6C and 6G) and the tapered clamping face 427*t* is adapted to slidingly engage with a correspondingly tapered clamping face 450*t* (not shown; see, FIGS. 6C-6G) of the lower clamping rail 450 when the clamping assembly 460 (not shown; see, FIGS. 5E and 5F) is used to removably clamp the fluid end assembly 420 to the spacer frame assembly 440, as will be further described below.

Depending on the specific clamping arrangement of the fluid end mounting system, the number of upper and lower clamping lips 425, 427 may have a 1:1 correspondence to the number of pump plungers 424 (not shown in FIG. 5C; see, FIG. 6C), which would therefore also provide a 1:1 correspondence to the number of discharge bores 417, access bores 429, etc. Furthermore, in such embodiments, each upper clamping lip 425 would be positioned substantially directly above a corresponding plunger 424 and each lower clamping lip 427 would be positioned substantially directly below the corresponding plunger 424, i.e., on a directly opposite side of the plunger 424 from a corresponding upper clamping lip 425. For example, in the illustrative embodiment depicted in FIG. 5C, the three upper clamping lips 425 would correspond to three plungers 424 (not shown) and three lower clamping lips 427 (one only shown in FIG. 5C). However, it should be understood by those of ordinary skill after a full reading of the present disclosure that, in at least some embodiments, the number of upper and lower clamping lips 425, 427 relative to the number of plungers 424 may vary, e.g., two each upper and lower clamping, lips 425, 427 for every one plunger 424.

In certain exemplary embodiments, each upper clamping lip 425 may be separated from an adjacent upper clamping lip 425 by an upper relief slot or notch 425*r*, and each lower clamping lip 427 may be separated from an adjacent lower clamping lip 427 by a similar lower relief notch (not shown in FIG. 5C). Each upper relief notch 425*r* may be configured and positioned so that a corresponding tie rod nut 423 on the upper clamping bar 448 that is used (together with a tie rod 422) to attach the spacer frame assembly 440 to the power end 410 can fit between adjacent upper clamping lips 425 substantially without interference. Similarly, each lower relief notch may be configured in comparable fashion so as to receive a corresponding tie rod nut 423 on the lower claim rail 450, thus again avoiding interference with the adjacent lower clamping lips 427. Furthermore, in at least some embodiments, the upper relief notches 425*r* and the lower relief notches may also act as alignment guides for properly positioning the fluid end assembly 420 on the lower clamping rail 450 and adjacent to the upper clamping bar 448, that facilitating an easier coupling of the fluid end plunger 424 to the pony rod 414 (neither shown in FIG. 5C; see, FIGS. 6A and 6C) on the power end 410 of the pump 400.

Figure 5D:
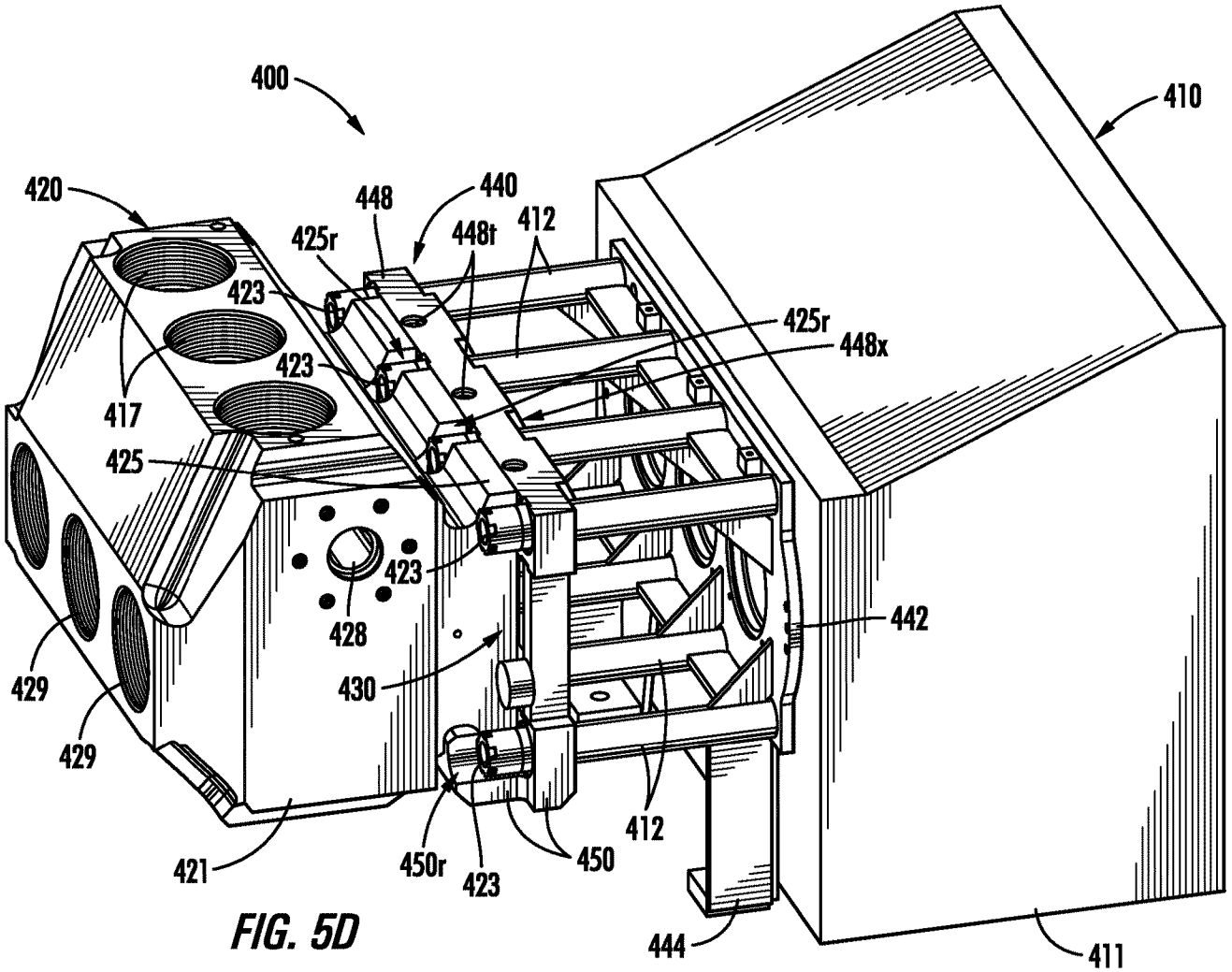

FIG. 5D shows the pump assembly 400 of FIG. 5C in a further assembly step, wherein the clamping boss 430 of the fluid end assembly 420 has been positioned against the spacer frame assembly 440 in preparation for removably clamping the fluid end 420 to the spacer frame 440. As shown in FIG. 5D), the center tie rod nuts 423 on the upper clamping bar 448 are straddling the upper clamping lips 425, and the center two upper tie rod nuts 423 are positioned at least partially in corresponding upper relief notches 425*r*. While not shown in FIG. 5D, the tie rod nuts 423 on the lower clamping rail 450 are similarly positioned with respect to the lower clamping lips 427 and the corresponding lower relief notches on the clamping boss 430.

Furthermore, in the assembly step depicted in FIG. 5D, the clamping boss 430 has been positioned so that a substantially vertical front clamping face 425*v* (not shown in FIG. 5D; see, FIGS. 6C and 6G) of the upper clamping lip 425 has been brought into contact with a corresponding substantially vertical front clamping face 448*v* (not shown; see, FIGS. 6C and 6G) of the upper clamping bar 448, and so that the backside tapered clamping face 425*t* on the upper clamping lip 425 has been brought into contact with the correspondingly tapered clamping face 462*t* of the clamp bar 462 (not shown; see, FIGS. 5E and 6C-6G). Similarly, a substantially vertical front clamping face 427*v* (not shown; see, FIGS. 6C-6G) of the lower clamping lip 427 has been brought into contact with a corresponding vertical front clamping face 450*v* (not shown; see, FIGS. 6C-6G) of the lower clamping rail 450 and the backside tapered clamping face 427*t* on the lower clamping lip 427 has been brought into contact with the correspondingly tapered clamping face 450*t* of the lower clamping rail 450 (not shown; see, FIGS. 6C-6G). Various additional detailed aspects of the substantially vertical front clamping faces 425*v*, 448*v*, 427*v*, 450*v* and the tapered clamping faces 425*t*, 462*t*, 427*t*, 450*t* will be described below in conjunction with FIGS. 6A-8E.

Figure 5E:
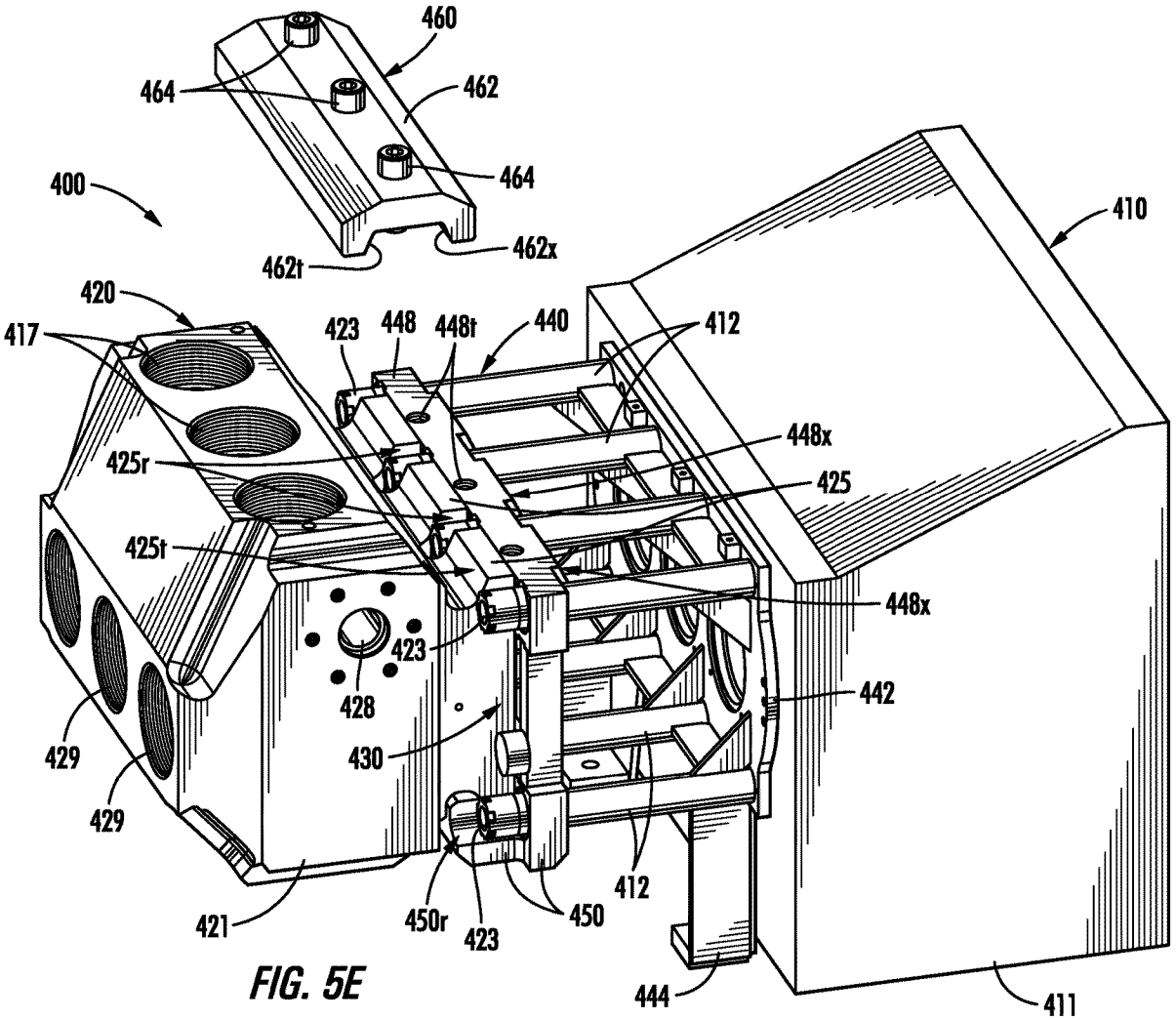

Turning now to FIG. 5E, a further assembly step is illustrated wherein the clamping assembly 460 has been positioned adjacent to and above the previously assembled components of the pump 400 after the fluid end assembly 420 has positioned in contact with the spacer frame assembly 440 in preparation for being removably clamped thereto. As shown in FIG. 5E the clamping assembly 460 may include a clamp bar 462 having tapered clamping faces 462*t* and 462*x* on the bottom or lower side thereof. See also, FIGS. 6G and 8C-8E. As noted previously, the tapered clamping faces 462*t* are adapted to slidingly engage the corresponding backside tapered clamping face 425*t* on the upper clamping lip 425 when the clamping assembly 460 is used to clamp the fluid end 420 to the spacer frame 440. On the other hand, the tapered clamping faces 462*x*, which are positioned substantially opposite of the tapered clamping faces 462*t* on the clamp bar 462, are adapted to slidingly engage a correspondingly tapered clamping face 448*x* on the back side of the upper clamping bar 448, i.e., substantially opposite of the vertical front clamping face 448*v* shown in FIG. 6G and described above. See also, FIGS. 8C-8E.

Furthermore, the clamping, assembly 460 may also include a plurality of fasteners 464, e.g., threaded fasteners such as machine bolts, socket head cap screws, and the like, which may be used to bolt, i.e., removably attached, the clamp bar 462 to the spacer frame assembly 440 while the spacer frame 440 is in the interfacing position with the fluid end assembly 420 as shown in FIGS. 5D and 5E. For example, in some embodiments, each of the fasteners 464 may be adapted to threadably engage a corresponding tapped hole 448*t* positioned in the upper surface of the upper clamping bar 448, and thereafter tightened to a predetermined bolt pre-load. This predetermined bolt pre-load may then in turn generate a high clamping force between the clamping elements of the fluid end assembly 420—i.e., the upper and lower clamping lips 425, 427—and the corresponding clawing elements of the spacer frame assembly 440—i.e., the upper clawing bar 448 and the lower clamping rail 450—due to the mechanical advantage provided by the various tapered clamping faces 425*t*, 462*t*, 462*x*, 448*x*, 427*t*, 450*t*, as will be further described in detail below.

Figure 5F:
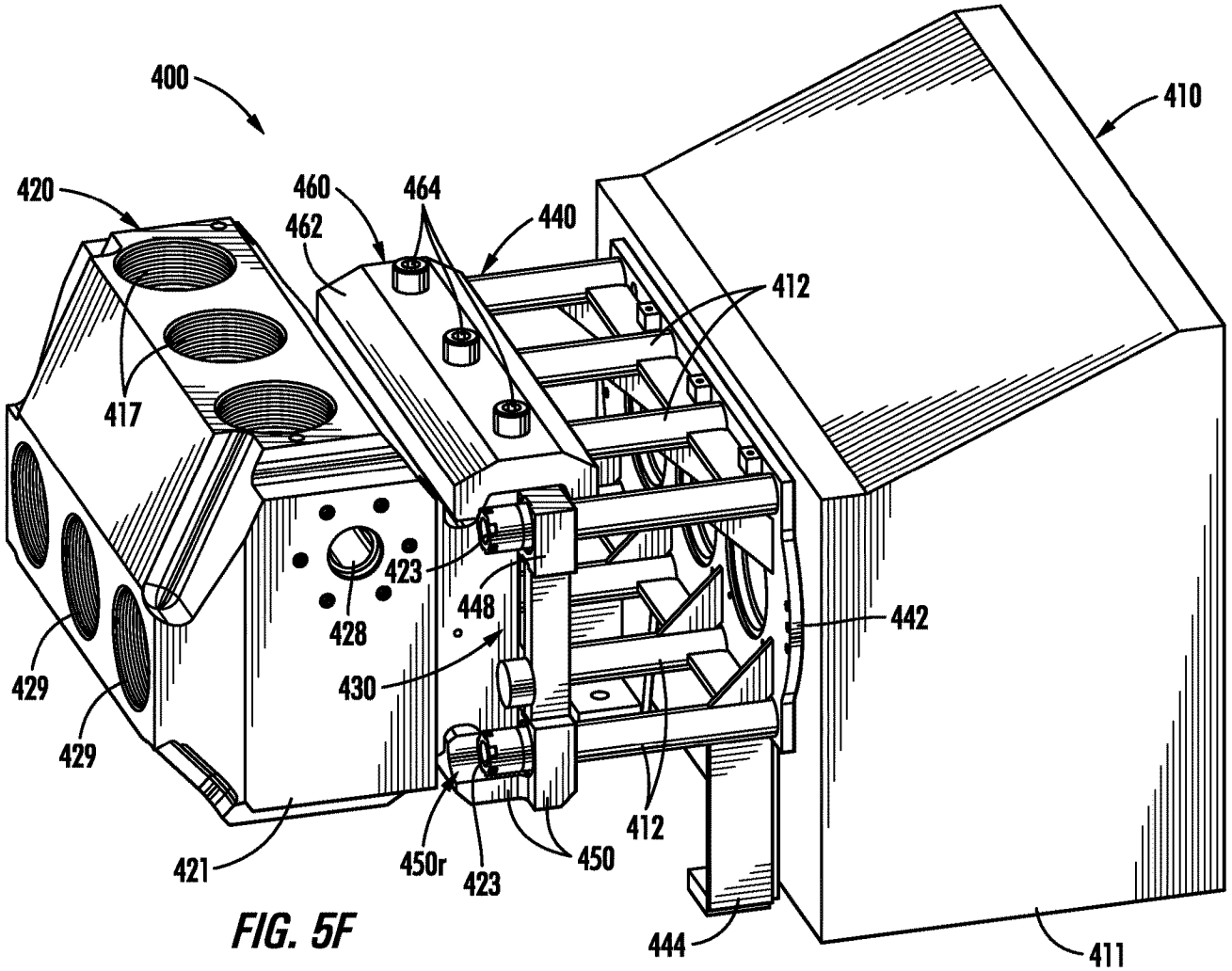

FIG. 5F shows the pump assembly 400 of FIG. 5E after the clamping assembly 460 has been removably attached to the upper clamping bar 448 with the fasteners 464, thereby removably clamping the fluid end assembly 420 to the spacer frame assembly 440. In certain embodiments, the fasteners 464 may have a nominal diameter in the range of about 25-50 mm (1-2 inches), and the torque pre-load that is used to tighten the fasteners 464 so as to clamp the fluid end 420 to the spacer frame 440 may be approximately 2700-5400 N-m (2000-4000 ft-lbs). In at least some embodiments, due to the mechanical advantage provided by the various tapered clamping faces described herein, the resulting high clamping pre-loads that are generated between the upper clamping lips 425 and the upper clamping bar 448 and between the lower clamping lips 427 and the lower clamping rail 450 may thereby reduce the magnitude of the alternating stresses that are created in at least some areas of the pump housing 421 of the fluid end 420 during pump operation. Such reduced magnitude alternating stresses may therefore lead to an overall decrease in the occurrence of detrimental fatigue cracks in the pump housing 421, thus resulting in an increased fatigue life of the fluid end 420 and extended operating periods between downtime replacements.

In view of the overall sequence of pump assembly steps described above, since the spacer frame assembly 440 is mounted on, i.e., removably attached to, the power end assembly 410 during an early assembly step, it is possible to mount or dismount the fluid end assembly 420 during a completely separate assembly step by simply attaching or detaching the clamping assembly 640. Therefore, since the fluid end 420 can generally be installed and/or removed from the pump 400 while the spacer frame 440 remains mounted in place on the power end 410, multiple fluid end installation and/or removal cycles, i.e., removable attachments, of the fluid end 420 to the spacer frame 440 and power end 410 may be performed substantially without disturbing the initial spacer frame installation. In this way, the more problematic alignment and assembly issues that are often associated with installing the tie rods 422 (see above) may be substantially avoided, thus significantly reducing the amount of downtime spent (and the costs associated therewith) in removing and replacing a damaged or defective fluid end assembly 420. It should be understood, however, that since the spacer frame assembly 440 is removably attached to the power end assembly 410 by the plurality of tie rods 422 and tie rod nuts 423, the spacer frame 440 may also be removed as may be required for maintenance of the power end 410, and for replacement or repair of the spacer frame 440.

Figure 6A:
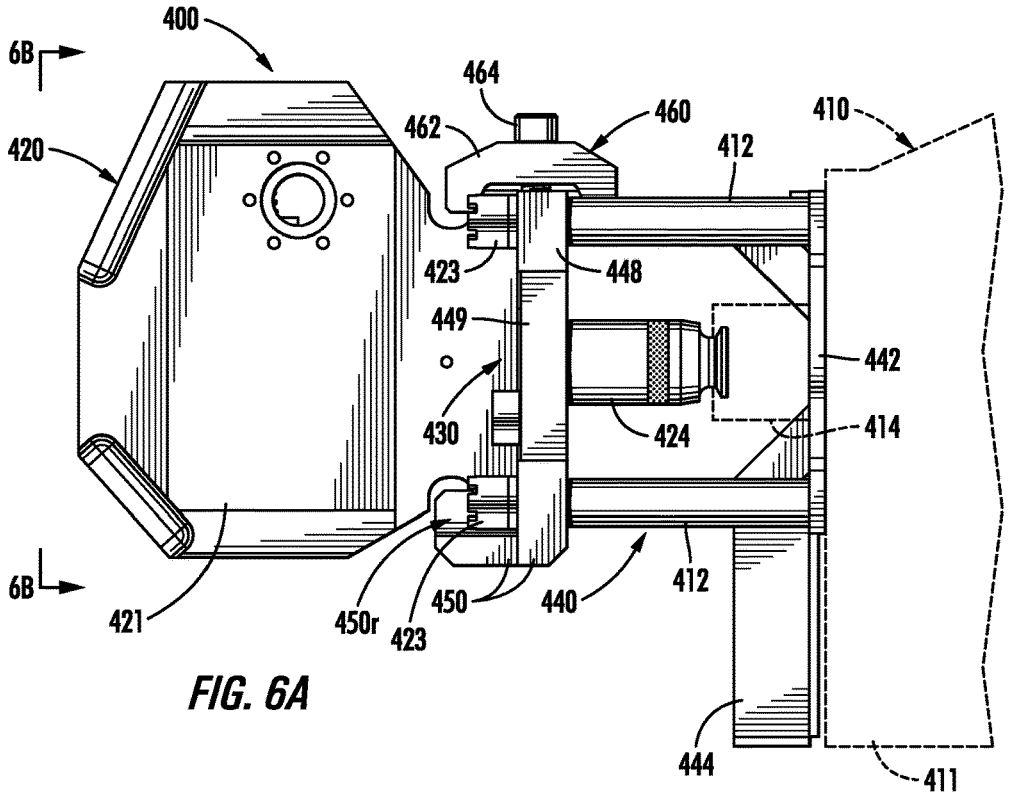
FIGS. 6A-6J depict various elevation, detail, and cross-sectional views of an illustrative reciprocating pump that utilizes one exemplary embodiment of a fluid end assembly mounting system disclosed herein.

FIGS. 6A-6J illustrate various views and details of the exemplary reciprocating pump assembly 400 depicted in FIG. 5F. In particular, FIG. 6A is a side elevation view of the pump 400 after the spacer frame assembly 440 has been mounted on the power end 410 (shown schematically only in FIGS. 6A, 6C, and 6G), and after the clamping assembly 460 has been used to clamp the fluid end assembly 420 to the spacer frame 440. In FIG. 6A, an illustrative pump plunger 424 is shown protruding from the fluid 420, and is coupled to the corresponding pony rod 414 (schematically shown in FIG. 6A) that protrudes from the power end 410 of the pump 400.

Figure 6B:
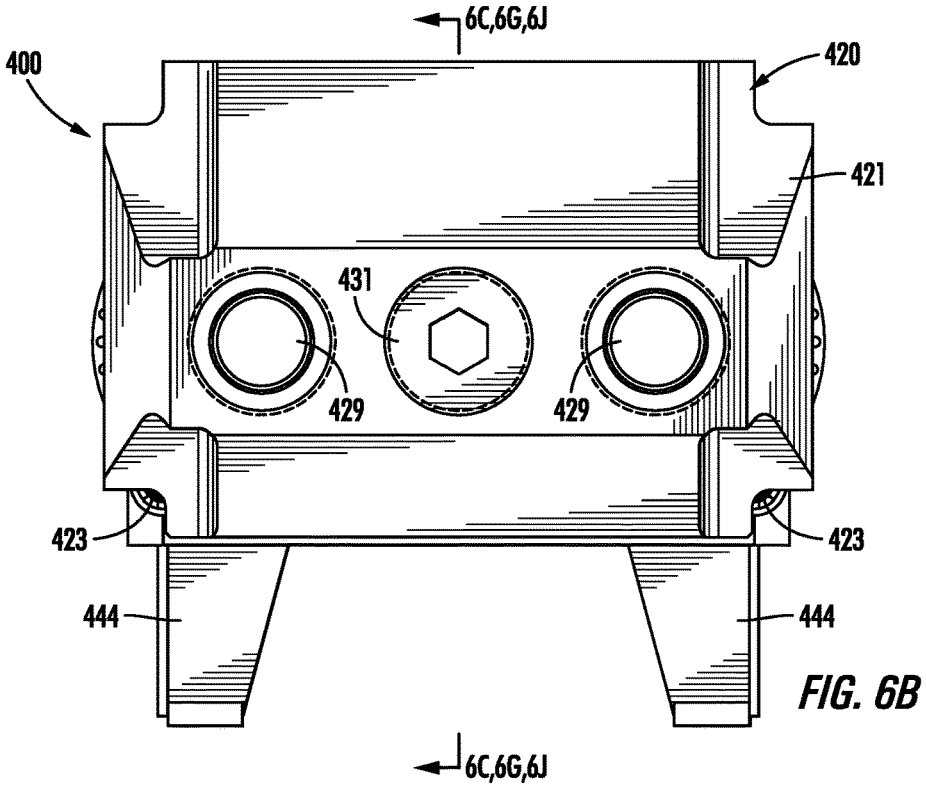

FIG. 6B is a front end elevation view of the pump 400 shown in FIG. 6A along the view line "6B-6B." In FIG. 6A, an access bore plug 431 is shown positioned in the center access bore 417 of the fluid end 420 whereas only open access bores 429 are shown for the remaining pump cylinders. It should be appreciated, however, that this configuration is illustrative only, as an access bore plug 431 typically would be positioned in each one of the access bores 429 during normal operation of the pump 400.

Figure 6C:
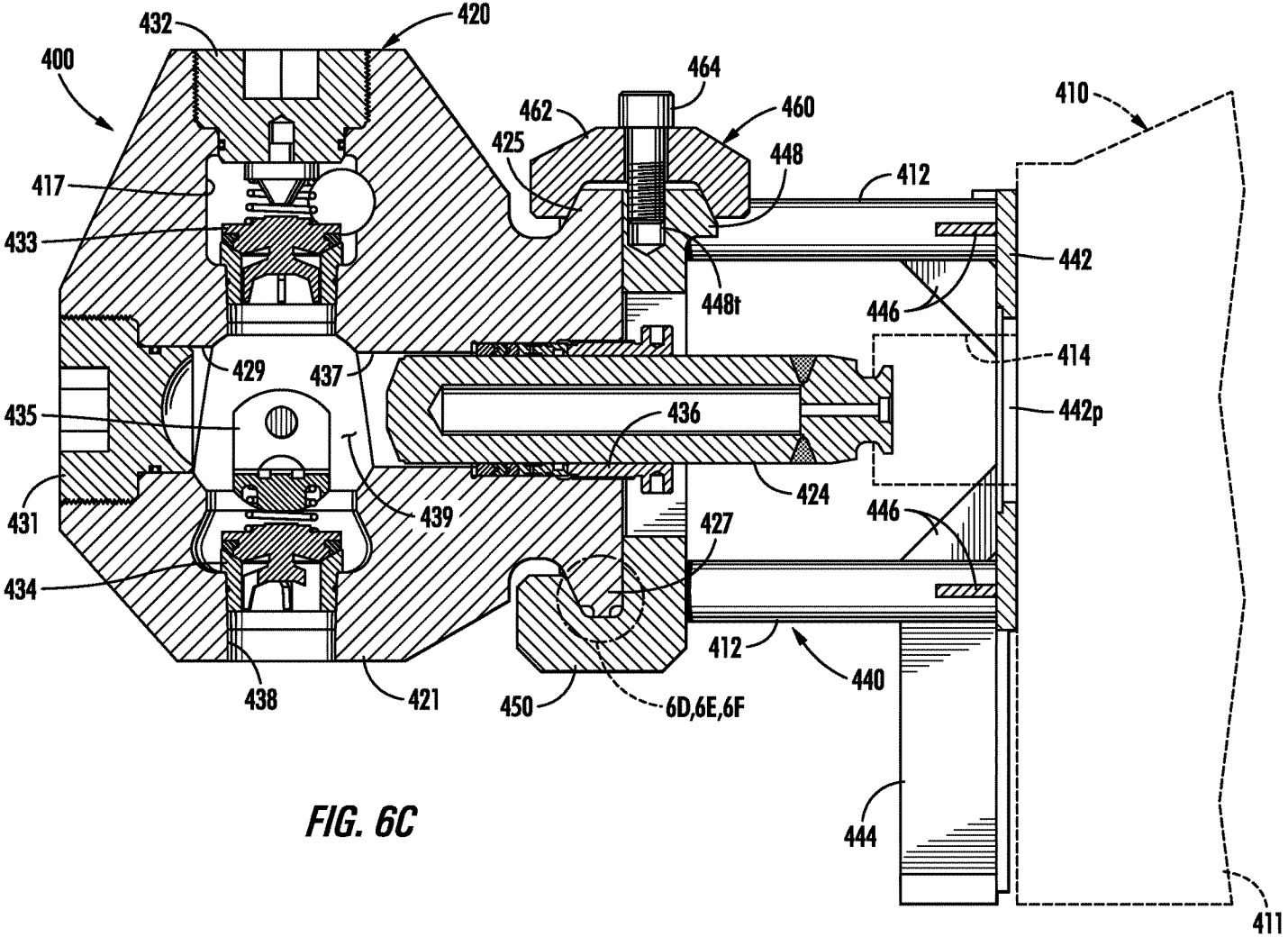
Figure 6F:
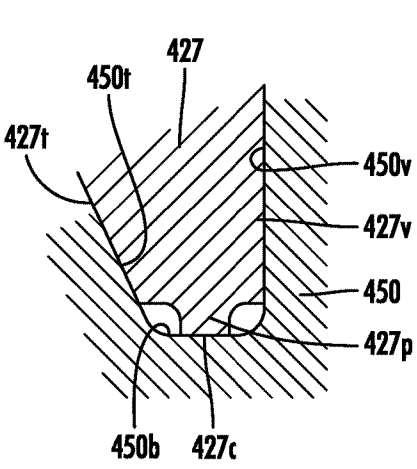
Figure 6E:
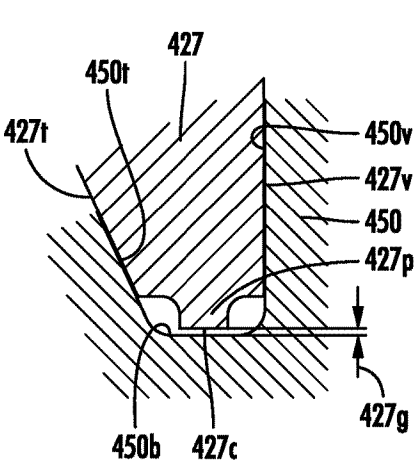
Figure 6D:
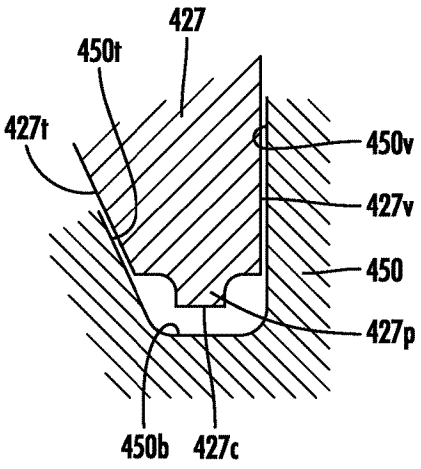
Figure 6I:
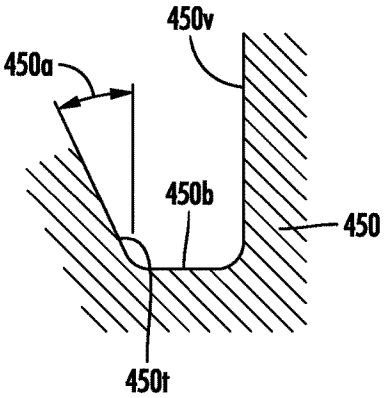
Figure 6H:
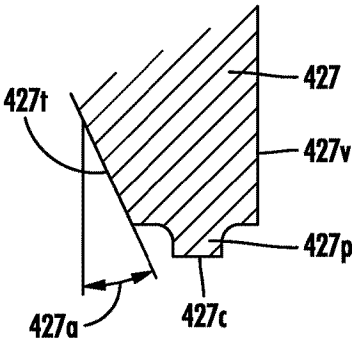
Figure 6G:
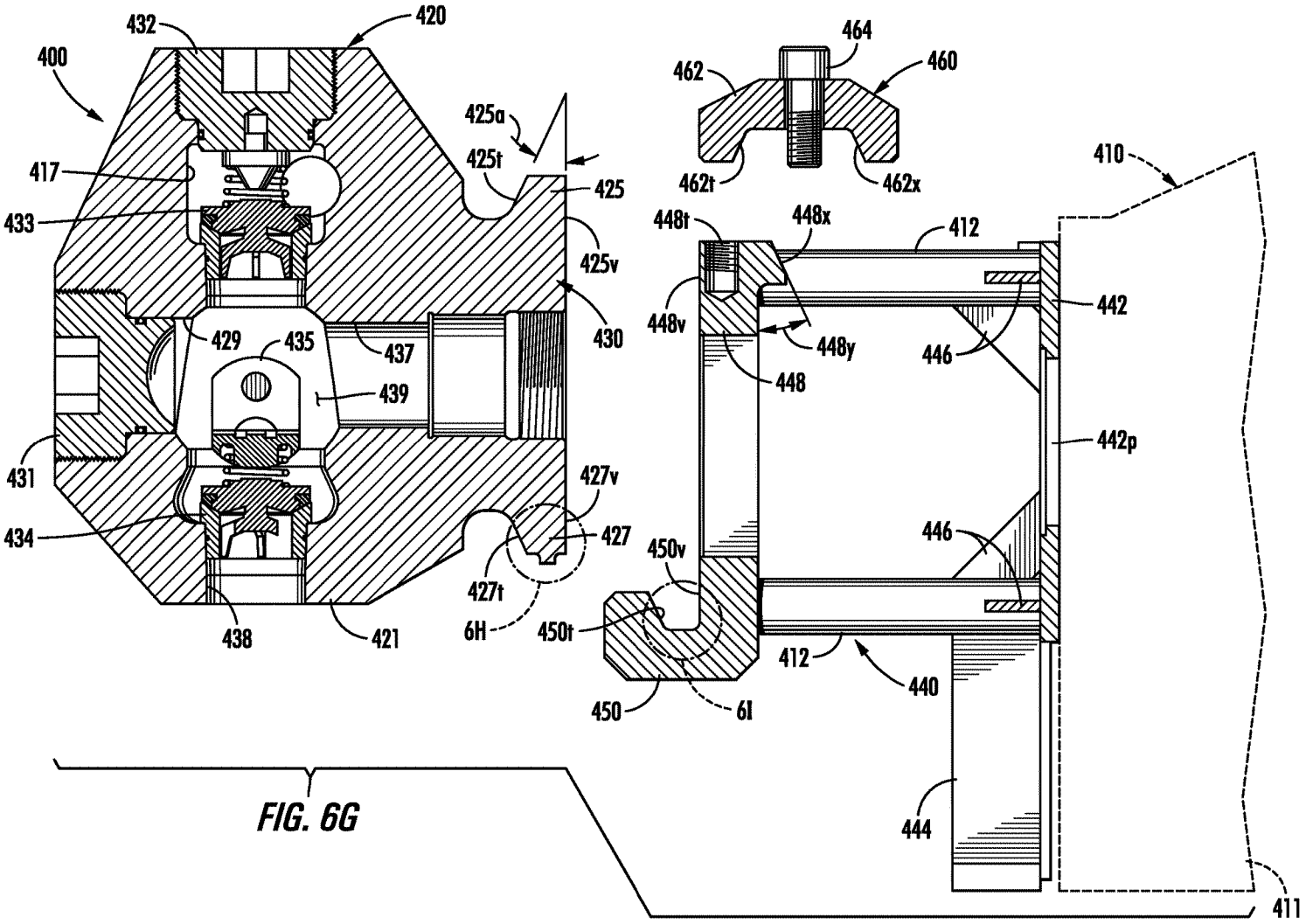
Figure 6J:
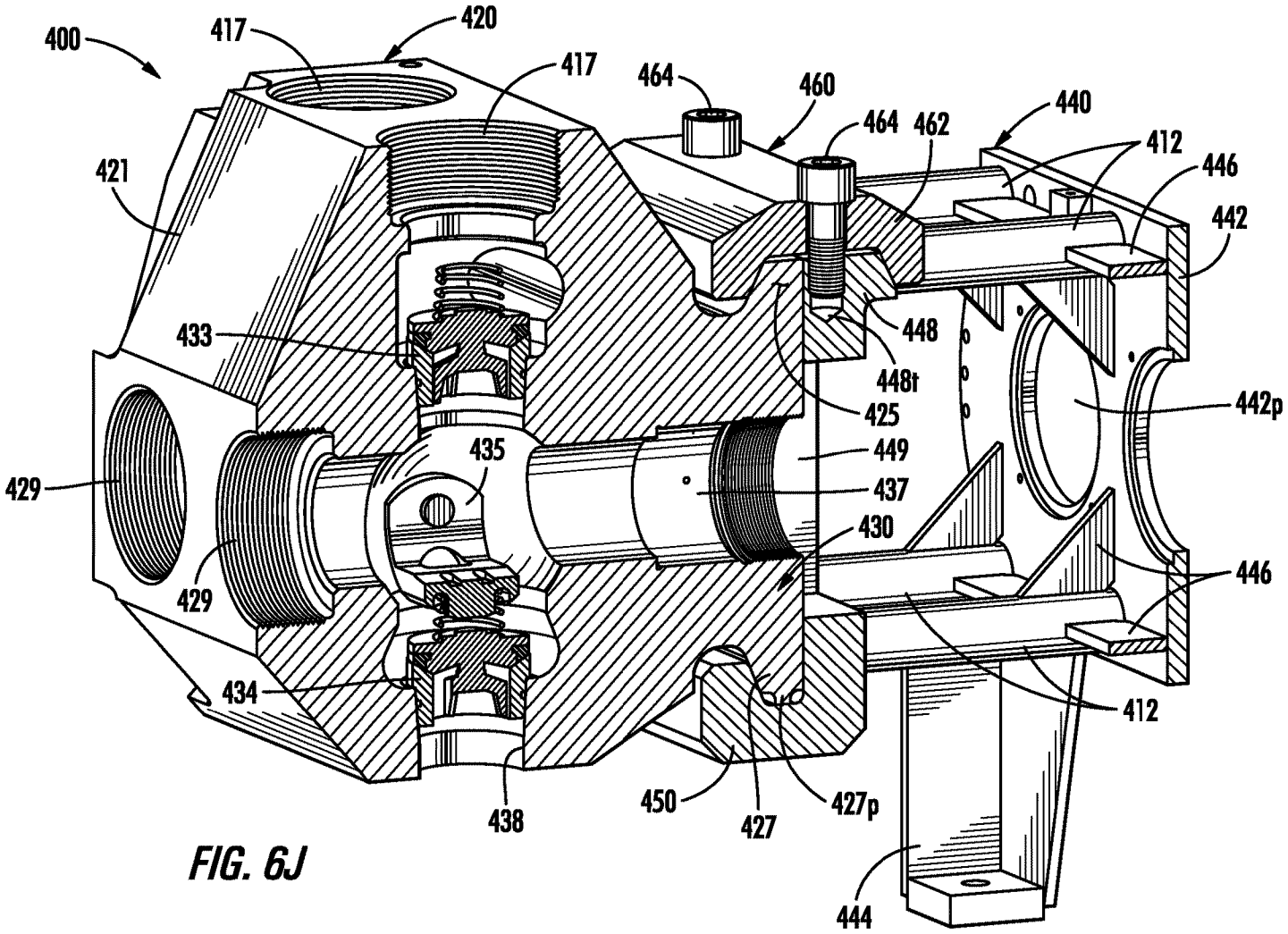
Figure 7A:
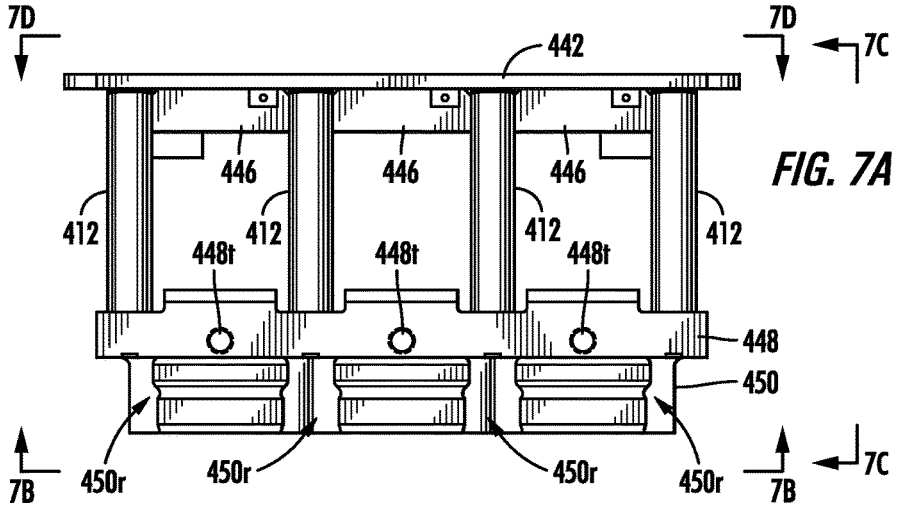
Figure 7B:
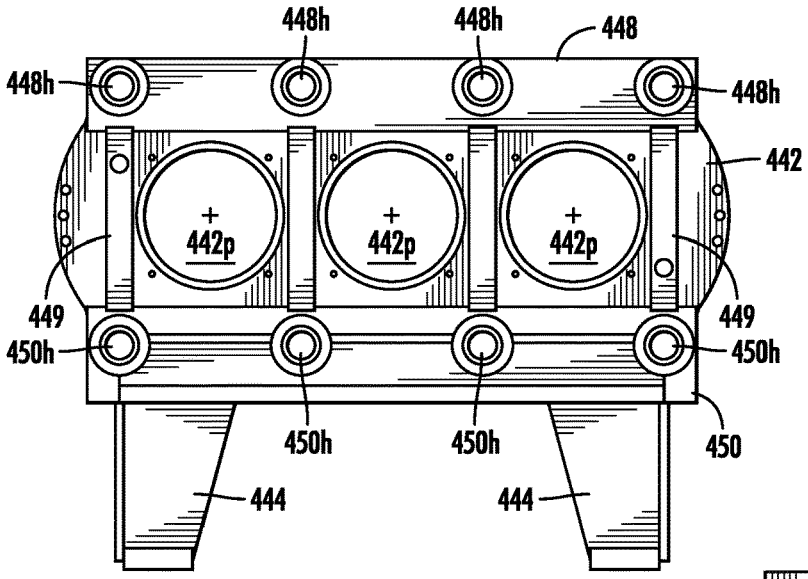
Figure 7C:
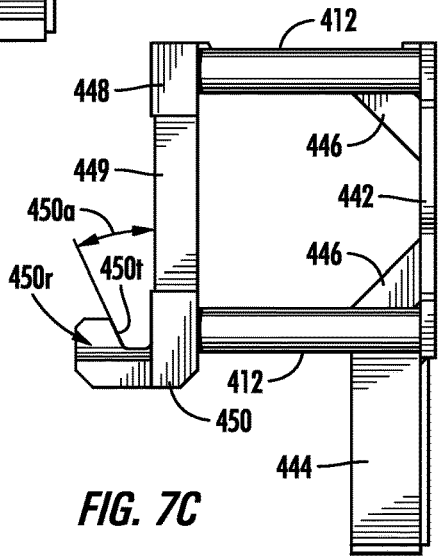

FIG. 6C is a cross-sectional view of the pump 400 of FIG. 6B along the section line "6C-6C." Similarly, FIG. 6G is an exploded cross-sectional view of the pump 400 along the section line "6G-6G" of FIG. 6B and FIG. 6J is an isometric cross-sectional view of the pump 400 along the section line "6J-6J," wherein however some internal pump elements have been removed from FIGS. 6G and 6J for clarity. As noted above with respect to FIG. 6B, the fluid end assembly 420 may include an access bore plug 431 (not shown in FIG. 6J) that is positioned in the access bore 429, which may be used to for pump inspection and/or maintenance activities during pump downtime. The fluid end 420 may also include a discharge bore plug 432 (also not shown in FIG. 6J) positioned in the discharge bore 417. In certain embodiments, the discharge bore plug 432 may be adapted to act as a discharge valve stop retainer device so as to maintain a discharge valve 433 in position inside of the discharge bore 417.

In some embodiments, the fluid end 420 may include a stuffing box 436 (not shown in FIG. 6G or 6J) positioned inside of the plunger bore 437, which is adapted affect a dynamic seal against the outside surface of a moving plunger 424 (also not shown in FIG. 6G or 6J) as the plunger reciprocates through the plunger bore 437 during pump operation. Furthermore, a suction valve 434 may be positioned inside of a suction bore 438, and a suction valve stop retainer device 435 that is adapted to maintain the suction valve 434 in its proper position inside of the suction bore 438 may be positioned above the suction valve 434, for example, in the cross-bore chamber 439.

Turning now to FIG. 6G, the upper clamping lips 425 that protrude from the clamping boss 430 (e.g., in a substantially upward direction from the clamping boss 430 in the exemplary pump orientation depicted) each have a substantially vertical front clamping face 425*v* and a backside tapered clamping face 425*t*. Additionally, as depicted in FIG. 6G the tapered clamping faces 425*t* may be oriented at an acute taper angle 425*a* relative to the front clamping faces 425*v*. Similarly, the lower clamping lips 427 protruding from the clamping boss 430 (e.g., in a substantially downward direction in the pump orientation depicted) have a substantially vertical front clamping face 427*v* and a backside tapered clamping face 427*t* that is oriented at an acute taper angle 427*a* relative to the front clamping faces 427*v*. See, detailed view "6H" from FIG. 6G of the lower clamping lips 427, shown in FIG. 6H. Additionally, in certain embodiments, one or more of the lower clamping lips 427 may include a protrusion element 427*p* having a lower contact face 427*c* that extends below a lower end of the clamping lips 427. In some aspects, the protrusion element may be sized and positioned so as to control or limit the amount of clamping pre-load that is generated by the clamping assembling 460 when mounting the fluid end 420 to the spacer assembly 440 by acting as a positive stop, as will be further described below.

In some illustrative embodiments, the taper angles 425*a* and 427*a* may be substantially the same angle, or they may be different angles depending on the requisite design parameters of the clamping configuration, such as desired clamping pre-load and the like. For example, in those embodiments where the taper angles 425*a* and 427*a* are substantially the same, the angles 425*a* and 427*a* may be in the range of about 20°-30°, and in at least one embodiment the taper angles 425*a* and 427*a* may be approximately 25°. It should be appreciated, however, that these angle sizes are exemplary only, as the sizes of the taper angles 425*a* and 427*a* may be either larger or smaller than the listed range.

FIG. 6I is a close-up detailed view "6I" from FIG. 6G showing the relationship of the various clamping faces 450*t*, 450*v*, and 450*b* of the "J-shaped" portion of the lower clamping rail 450. As shown in FIG. 6I, the lower clamping rail 450 may have substantially vertical front clamping faces 450*v* that are adapted to contact respective vertical front clamping faces 427*v* of the lower clamping lips 427 when the fluid end assembly 420 is mounted on, i.e., attached to, the spacer frame assembly 440. As shown in FIG. 6I, the lower clamping rail 450 may also have tapered clamping faces 450*t* that are oriented at an acute taper angle 450*a* relative to the front clamping faces 450*v*, as well as bottom clamping faces 450*b* that are adapted to contact the contact faces 427*c* of the protrusion elements 427*p* as the fluid end 420 is clamped in place against the spacer frame 440 by the clamping assembly 460, as will be further described below. Additionally, and as noted above, the tapered clamping faces 450*t* of the lower clamping rail 450 are adapted to slidingly engage the corresponding tapered rear clamping faces 427*t* of the lower clamping lips 427 when the fluid end 420 is mounted on the spacer frame 440 and clamped in place with the clamping assembly 460. Accordingly, in various aspects of the present disclosure, the taper angle 450*a* of the tapered clamping faces 450*t* may be substantially the same as the taper angle 427*a* of the tapered clamping faces 427*t*, thus facilitating the above-described sliding engagement during fluid end assembly make-up.

Returning now to FIG. 6G, the upper clamping bar 448 may have substantially vertical front clamping faces 448*v* that are adapted to contact the respective front clamping faces 425*v* on the upper clamping lips 425 when the fluid end assembly 420 is mounted on the spacer frame assembly 440. Additionally, the upper clamping bar 448 may also have tapered clamping faces 448*x* that are oriented at an acute taper angle 448*y* relative to the front clamping faces 448*v*. As noted previously, the tapered clamping faces 425*t* on the upper clamping lip 425 and the tapered clamping faces 448*x* on the upper clamping bar 448 are adapted to slidingly engage tapered clamping faces 462*t* and 462*x*, respectively, on the clamp bar 462 during the assembly step when the clamping assembly 460 is used to clamp the fluid end 620 to the spacer frame 440. Therefore, in at least some exemplary embodiments, the taper angle 425*a* may be substantially the same as an acute taper angle 462*a* of the tapered clamping faces 462*t* (not shown in FIG. 6G; see, FIG. 8D), and the acute taper angle 448*y* may be substantially the same as an acute taper angle 462*y* of the tapered clamping faces 462*t* (not shown in FIG. 6G; see, FIG. 8D), thus facilitating such sliding engagement.

FIGS. 6D, 6E, and 6F are close-up detailed views "6D," "6E," and "6F" from FIG. 6C, which show the interfacing relationship between the clamping surfaces of the lower clamping lips 427 and the "J-shaped" portion of the lower clamping rail 450 as the fluid end assembly 420 is: 1) positioned closely adjacent to the spacer frame assembly 440 (FIG. 6D); 2) brought into contact with the clamping faces of the spacer frame assembly 440 (FIG. 6E); and 3) clamped in place against the spacer frame assembly 440 by actuation of the clamping assembly 460 (FIG. 6F).

As shown in FIG. 6D, the fluid end assembly 420 is initially positioned adjacent to the spacer frame assembly 440 such that the lower clamping lips 427 is positioned substantially inside of the "J-shaped" opening defined by the vertical, bottom, and tapered clamping faces 450*v*, 450*b*, and 450*t*, respectively, of the lower clamping rail 450. In this position, the clamping faces 427*t* and 427*v* of the lower clamping lips 427 may be positioned proximate the respective clamping faces 450*t* and 450*v* of the lower clamping rail 450. Thereafter, as shown in FIG. 6E, the fluid end assembly 420 is lowered relative to the spacer frame assembly 440 until the tapered clamping faces 427*t* are in contact with the corresponding tapered clamping faces 450*t* and the front clamping faces 427*v* are in contact with the corresponding front clamping faces 450*v*. Furthermore, in this position the substantially vertical front clamping faces 425*v* on the upper clamping lips 425 may also be substantially in contact with the corresponding substantially vertical front clamping faces 448*v* on the upper clamping bar 448, i.e., in preparation for final clamping by the clamping assembly 460. See, FIGS. 5D and 5E. Additionally, the lower contact faces 427*c* of the protrusion elements 427*p* on the lower clamping lips 427 is positioned a predetermined gap distance 427*g* away from the bottom clamping surface 450*b* of the lower clamping rail 450.

FIG. 6F illustrates the interfacing relationship between the lower clamping rail 450 and the lower clamping lips 427 after the clamping assembly 460 has been mounted on the fluid end assembly 420 and the spacer frame assembly 440 and used to close the gap 427*g*, thus bringing the contact faces 427*c* of the protrusion elements 427*p* into contact with the corresponding bottom clamping faces 450*b* of the "J-shaped" portion of the lower clamping rail 450. For example, the clamping assembly 460 may be mounted on the fluid end 420 and the spacer frame 440 by bringing the tapered clamping faces 462*t* and 462*x* of the clamp bar 462 into contact with the corresponding tapered clamping faces 425*t* and 448*x* of the upper clamping lip 425 and upper clamping bar 448, respectively. Thereafter, the fasteners 464 may be threadably engaged with the tapped holes 448*t* in the upper clamping bar 448 and tightened as described above until the gap 427*g* is closed and the contact faces 427*c* are in contact with the bottom clamping faces 450*b*. In this way, an appropriate degree of "interference fit" may be induced between the lower clamping lips 427 and the "J-shaped" portion of the lower clamping rail 450, which may in turn provide a desired degree of clamping pre-load that acts to reduce the magnitude of any alternating stresses that occur in the clamp bar 462, in the fasteners 464 that attach the clamp bar 462 to the spacer frame assembly 440, and in the "J-shaped" portion of the lower clamping rail 450. Moreover, in some embodiments, the clamping pre-load may also act to reduce the magnitude of the alternating stresses that generally occur in the pump housing 421 during normal pump operation, and which often lead to the type of premature fatigue cracking and/or pump failure described above.

The predetermined gap distance 427*g* may be established based upon a desired amount of "interference fit" and consequent clamping pre-load so as to reduce and/or minimize the type of fatigue-related problems associated with high pressure reciprocating pumps. For example, in some embodiments, the predetermined gap distance 427*g* may be in the range of approximately 0.25-5.00 mm (0.010-0.200 inches). Furthermore, it should be understood by those of ordinary skill after a complete reading of the present disclosure that gap distance 427*g* used for any given configuration of clamping elements may vary depending on the size of the various acute taper angles 425*a*, 427*a*, 450*a*, 462*a*, 462*y*, and/or 448*y*.

Figure 8A:
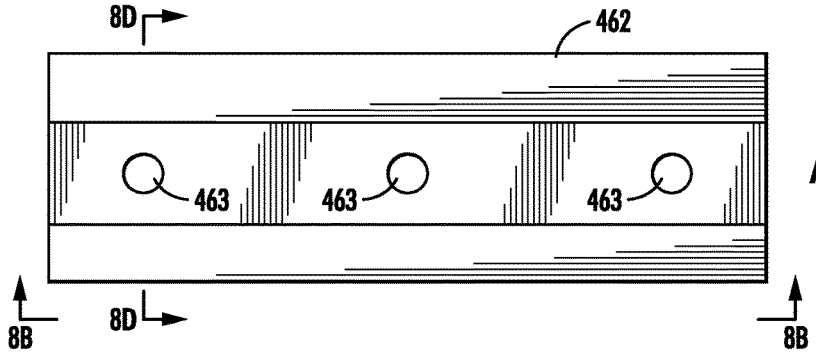
FIGS. 8A-8E illustrate various plan, elevation, cross-sectional, and isometric views of an exemplary clamping assembly that may be used in accordance with some embodiments disclosed herein to connect the fluid end assembly of a reciprocating pump to the illustrative spacer frame shown in FIGS. 7A-7E.
Figure 8B:
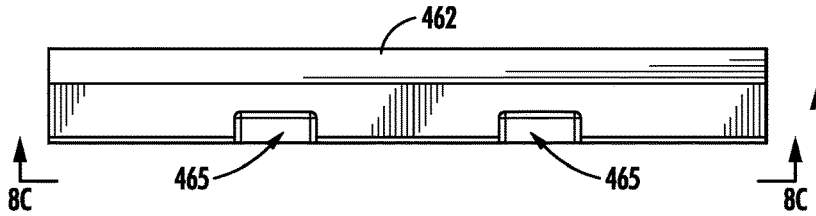
Figure 8C:
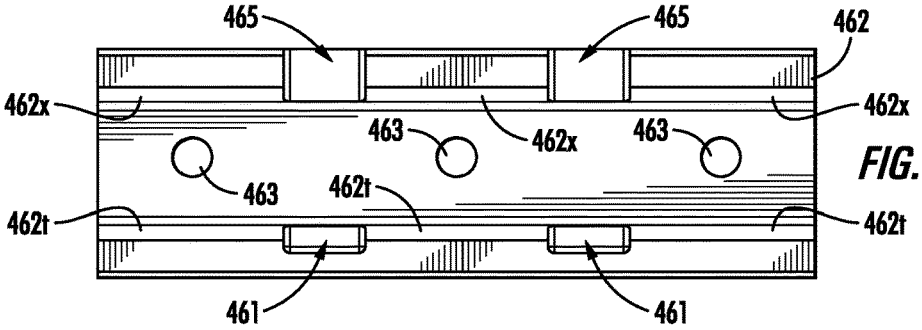
Figure 8D:
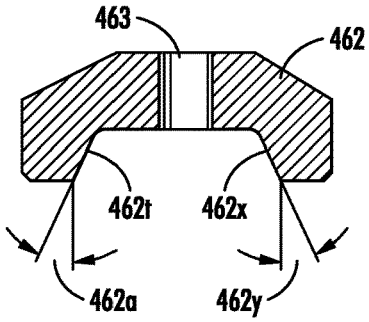
Figure 8E:
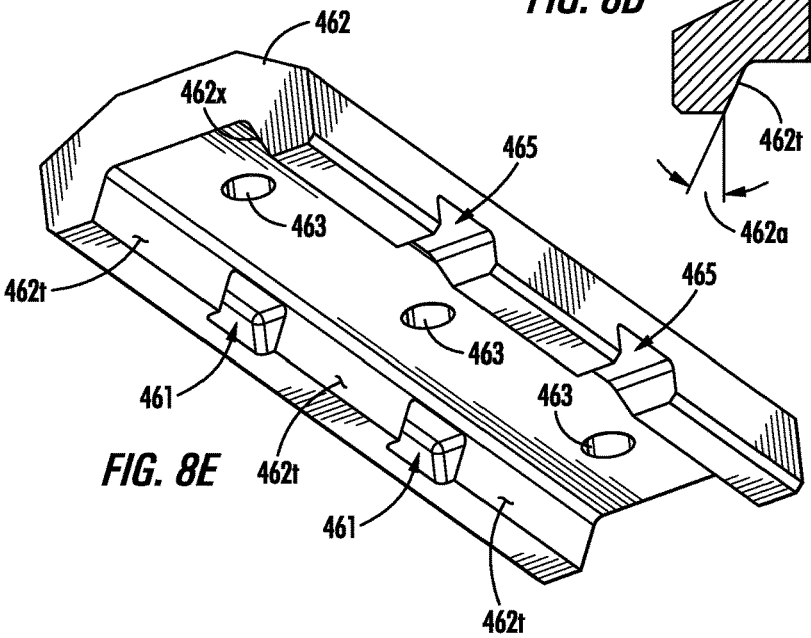

Turning now to FIGS. 8A-8E, some additional aspects of the clamp bar 462 will not be described. In particular, FIG. 8A is a top down (plan) view of the clamp bar 462, FIG. 8B is a side elevation view of the clamp bar 462 along the view line "8B-8B" of FIG. 8A, and FIG. 8C is a bottom up view of the clamp bar 462 along the view line "8C-8C" of FIG. 8B. Additionally, FIG. 8D is a cross-sectional view of the clamp bar 462 along the section line "8D-8D" of FIG. 8A, and FIG. 8E is an isometric view of the clamp bar 462 when viewed from below.

In some embodiments, the clamp bar 462 may include a plurality of bolt holes 463, i.e., one each for the number of fasteners 464 that are used to clamp the clamp bar 462 into place on the fluid end assembly 420 and the spacer frame assembly 440. Additionally, the clamp bar 462 may include a plurality of nut relief notches 461 that are sized and positioned so as to allow the clamp bar 462 to be mounted on the upper clamping lips 425 of the fluid end 420 without interfering with the tie rod nuts 423 that are positioned between each of the adjacent upper clamping lips 425. The clamp bar 462 may also include a plurality of spacer tube relief notches 465 that are substantially aligned with the corresponding nut relief notches 461. Furthermore, the spacer tube relief notches 465 may be similarly sized and positioned so as to allow the clamp bar 462 to be mounted on the upper clamping bar 448 of the spacer assembly 420 without interfering with the spacer tubes 412 that extend between the upper clamping bar 448 and the rear plate 442, and correspond to the tie rod nuts 423 for which the nut relief notches 461 may be required.

The present disclosure therefore describes various systems, devices, and methods that may be used to speed up and simplify the removal and replacement of a fluid end assembly of a reciprocating pump. Additionally, the systems and methods disclosed herein may also reduce or minimize at least some of the fatigue-related defects that occur in the fluid end of reciprocating pumps that are exposed to extreme service cyclic loading.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown. It is therefore evident that the particular embodiments disclosed above may be altered or modified and all such variations are considered within the scope and spirit of the invention. Accordingly, the protection sought herein is as set forth in the claims below.

What is claimed:

1. A system for mounting a fluid end of a pump to a power end of said pump, the system comprising:

an upper clamping bar;

a clamping assembly that is adapted to removably clamp said fluid end to said upper clamping bar, said clamping assembly comprising a clamp bar having a first tapered clamping face that is adapted to contact a correspondingly tapered clamping face on said upper clamping bar when said fluid end is removably clamped to said upper clamping bar; and a lower clamping rail having a tapered clamping face that is adapted to contact a correspondingly tapered clamping face on a lower clamping lip of said fluid end when said fluid end is removably clamped to said upper clamping bar, wherein said lower clamping rail is positioned vertically below said upper clamping bar.

2. The system of claim 1, wherein said upper clamping bar has a front clamping face that is adapted to contact a front clamping face on an upper clamping lip of said fluid end and said lower clamping rail has a front clamping face that is adapted to contact a front clamping face on said lower clamping lip when said fluid end is removably clamped to said upper clamping bar.

3. The system of claim 1, wherein said upper clamping bar and said lower clamping rail comprise a spacer frame that is adapted to be positioned between said fluid end and said power end when said fluid end is removably clamped to said upper clamping bar.

4. The system of claim 1, wherein said clamping assembly further comprises a plurality of fasteners that are adapted to removably attach said clamp bar to said upper clamping bar, said first tapered clamping face on said clamp bar being adapted to slidingly engage said correspondingly tapered clamping face on said upper clamping bar and a second tapered clamping face on said clamp bar being adapted to slidingly engage a correspondingly tapered clamping face on an upper clamping lip of said fluid end as said plurality of fasteners removably attaching said clamp bar to said upper clamping bar are tightened to a predetermined preload.

5. The system of claim 1, wherein a second tapered clamping face on said clamp bar is adapted to contact a correspondingly tapered clamping face on an upper clamping lip of said fluid end when said fluid end is removably clamped to said upper clamping bar.

6. The system of claim 5, wherein a front clamping face on said upper clamping bar is adapted to contact a front clamping face on said upper clamping lip when said fluid end is removably clamped to said upper clamping bar, wherein said tapered clamping face on said upper clamping bar is oriented at a first acute angle relative to said front clamping face on said upper clamping bar, and wherein said tapered clamping face on said upper clamping lip is oriented at a second acute angle relative to said front clamping face on said upper clamping lip.

7. The system of claim 1, wherein said lower clamping rail has a front clamping face that is adapted to contact a front clamping face on said lower clamping lip of said fluid end when said fluid end is removably clamped to said upper clamping bar, wherein said tapered clamping face on said lower clamping rail is oriented at a first acute angle relative to said front clamping face on said lower clamping rail, and wherein said tapered clamping face on said lower clamping lip is oriented at a second acute angle relative to said front clamping face on said lower clamping lip, said first acute angle being substantially the same as said second acute angle.

8. The system of claim 7, wherein said lower clamping rail comprises a bottom clamping face that is positioned between said front clamping face and said tapered clamping face of said lower clamping rail and is oriented vertically upward toward said upper clamping bar, said bottom clamping face being adapted to be brought into contact with a contact face of a protrusion element extending from said lower clamping lip when said fluid end is removably clamped to said upper clamping bar, wherein said protrusion element is a positive stop protrusion element that is adapted to control a clamping preload imposed on said fluid end when said fluid end is removably clamped to said upper clamping bar.

9. A pump assembly, comprising:

a fluid end assembly that is adapted to pump a fluid, said fluid end assembly comprising an upper clamping lip and a lower clamping lip that is positioned vertically below said upper clamping lip;

a power end assembly that is adapted to generate pumping power so as to drive said fluid end assembly;

an upper clamping bar and a lower clamping rail coupled to said power end assembly, said lower clamping rail being positioned vertically below said upper clamping bar; and a clamping assembly removably clamping said upper clamping lip of said fluid end assembly to said upper clamping bar and said lower clamping lip of said fluid end assembly to said lower clamping rail.

10. The pump assembly of claim 9, wherein said clamping assembly comprises a clamp bar and a plurality of fasteners removably attaching said clamp bar to said upper clamping bar.

11. The pump assembly of claim 10, wherein said upper clamping lip has a tapered clamping face in contact with a correspondingly tapered first clamping face on said clamp bar.

12. The pump assembly of claim 11, wherein said upper clamping bar has a tapered clamping face in contact with a correspondingly tapered second clamping face on said clamp bar and a front clamping face in contact with a front clamping face on said upper clamping lip, and wherein said lower clamping rail has a tapered clamping face in contact with a correspondingly tapered clamping face on said lower clamping lip and a front clamping face in contact with a front clamping face on said lower clamping lip.

13. The pump assembly of claim 12, wherein said lower clamping rail comprises a bottom clamping face that is positioned between said front clamping face and said tapered clamping face of said lower clamping rail and is oriented vertically upward toward said upper clamping bar, said bottom clamping face being in contact with a contact face of a positive stop protrusion element that extends from said lower clamping lip.

14. The pump assembly of claim 12, wherein said tapered clamping face on said upper clamping bar is oriented at a first acute angle relative to said front clamping face on said upper clamping bar, and wherein said tapered clamping face on said lower clamping rail is oriented at a second acute angle relative to said front clamping face on said lower clamping rail.

15. The pump assembly of claim 11, wherein said tapered clamping face on said upper clamping lip is oriented at a first acute angle relative to a front clamping face on said upper clamping lip.

16. The pump assembly of claim 9, wherein said upper clamping bar and said lower clamping rail comprise a spacer frame assembly that is removably attached to said power end assembly.

17. A pump fluid end assembly that is adapted to be removably clamped to a pump power end assembly, the pump fluid end assembly comprising:

a pump housing; and an upper clamping lip extending from said pump housing, said upper clamping lip having a front clamping face and a tapered clamping face that is oriented at a first acute angle relative to said front clamping face, wherein said front clamping face is adapted to slidingly engage a front clamping face of an upper clamping bar that is coupled to said pump power end assembly and said tapered clamping face is adapted to slidingly engage a correspondingly tapered clamping face of a clamp bar when a clamping assembly comprising said clamp bar is used to removably clamp said pump fluid end assembly to said pump power end assembly.

18. The pump fluid end assembly of claim 17, further comprising a lower clamping lip extending from said pump housing, said lower clamping lip having a front clamping face and a tapered clamping face that is oriented at a second acute angle relative to said front clamping face.

19. The pump fluid end assembly of claim 18, wherein said front clamping face of said second clamping lip is adapted to slidingly engage a front clamping face of a lower clamping rail that is coupled to said pump power end assembly and said tapered clamping face of said second clamping lip is adapted to slidingly engage a correspondingly tapered clamping face of said lower clamping rail when said pump fluid end assembly is removably clamped to said pump power end assembly.

20. The pump fluid end assembly of claim 18, further comprising a plunger bore extending through at least a portion of said pump housing, wherein said upper clamping lip is positioned on a first side of said plunger bore and said lower clamping lip is positioned on a second side of said plunger bore that is diametrically opposed to said first side.

21. The pump fluid end assembly of claim 18, wherein said pump housing comprises a clamping boss, said upper and lower clamping lips extending from opposite sides of said clamping boss.

22. A method for removably mounting a fluid end assembly of a pump assembly to a power end assembly of said pump assembly, the method comprising:

removably attaching a spacer frame assembly to said power end assembly;

after removably attaching said spacer frame assembly to said power end assembly, positioning a plurality of clamping faces of said fluid end assembly in contact with a plurality of corresponding clamping faces of said removably attached spacer frame assembly; and removably clamping said fluid end assembly to said spacer frame assembly with a clamping assembly, wherein removably clamping said fluid end assembly to said spacer frame assembly with said clamping assembly comprises:

positioning a clamp bar on said fluid end assembly and said spacer frame assembly so that a first tapered clamping face of said clamp bar is in contact with a correspondingly tapered clamping face of an upper clamping lip of said fluid end assembly and a second tapered clamping face of said clamp bar is in contact with a correspondingly tapered clamping surface of an upper clamping bar of said spacer frame assembly;

removably attaching said clamp bar to said spacer frame assembly with a plurality of fasteners; and tightening said plurality of fasteners so that said first tapered clamping face of said clamp bar slidingly engages said tapered clamping face of said upper clamping lip and said second tapered clamping face of said clamp bar slidingly engages said tapered clamping surface of said upper clamping bar.

23. The method of claim 22, further comprising tightening said plurality of fasteners so that each of said plurality of clamping faces of said fluid end assembly slidingly engages a respective one of said plurality of corresponding clamping faces of said removably attached spacer frame assembly.

* * * * *